US005199805A

United States Patent [19]

Kawazoe et al.

[11] Patent Number: 5,199,805

[45] Date of Patent: Apr. 6, 1993

[54] IMAGE RECORDING APPARATUS AND INK SHEET CASSETTE APPLICABLE THEREIN

[75] Inventors: Kenji Kawazoe, Kawasaki; Yoshio Uchikata, Yokohama, both of Japan

[73] Assignee: Canon Kabushiki Kaisha, Tokyo, Japan

[21] Appl. No.: 751,562

[22] Filed: Aug. 22, 1991

Related U.S. Application Data

[63] Continuation of Ser. No. 501,437, Mar. 22, 1990, abandoned, which is a continuation of Ser. No. 15,141, Feb. 17, 1987, abandoned.

[30] Foreign Application Priority Data

Feb. 18, 1986 [JP] Japan ..... 61-31808
Feb. 18, 1986 [JP] Japan ..... 61-31809
Aug. 6, 1986 [JP] Japan ..... 61-184551

[51] Int. Cl.[5] ..... B41J 35/04; B41J 2/325

[52] U.S. Cl. ..... 400/248; 400/120; 400/208; 400/695; 346/76 PH

[58] Field of Search ..... 400/120, 208, 42, 234, 400/248, 356, 695, 696, 697, 697.1; 346/76 PH

[56] References Cited

U.S. PATENT DOCUMENTS

| | | | |
|---|---|---|---|
| 3,974,906 | 8/1976 | Lee et al. | 400/208 |
| 4,203,676 | 5/1980 | Hatsell | 400/248 |
| 4,280,767 | 7/1981 | Heath | 400/216.2 |
| 4,329,075 | 5/1982 | Applegate et al. | 400/248 |
| 4,384,797 | 5/1983 | Anderson et al. | 400/696 |
| 4,396,308 | 8/1983 | Applegate et al. | 400/696 |
| 4,407,593 | 10/1983 | Haftmann | 400/208 |
| 4,428,695 | 1/1984 | Jamieson | 400/208 |
| 4,486,107 | 12/1984 | Willcox | 400/248 |
| 4,545,693 | 10/1985 | Bartlett et al. | 400/696 |
| 4,547,088 | 10/1985 | Shattuck | 400/120 |
| 4,572,687 | 2/1986 | Croley et al. | 400/696 |
| 4,644,371 | 2/1987 | Matsuura et al. | 400/120 |
| 4,651,162 | 3/1987 | Nakamura et al. | 400/696 |
| 4,655,623 | 4/1987 | Gasser | 400/208 |
| 4,657,418 | 4/1987 | Lahr | 400/212 |
| 4,661,004 | 4/1987 | Applegate et al. | 400/208 |
| 4,672,393 | 6/1987 | Uchikata et al. | 400/120 |
| 4,750,007 | 6/1988 | Suzuki | 400/248 |

FOREIGN PATENT DOCUMENTS

| | | | |
|---|---|---|---|
| 3119025 | 3/1982 | Fed. Rep. of Germany . | |
| 3241768 | 11/1982 | Fed. Rep. of Germany . | |
| 3440690 | 5/1985 | Fed. Rep. of Germany . | |
| 69187 | 6/1981 | Japan . | |
| 162682 | 12/1981 | Japan . | |
| 138973 | 8/1982 | Japan | 400/212 |
| 179393 | 10/1984 | Japan | 400/248 |
| 199281 | 11/1984 | Japan | 400/248 |
| 173358 | 11/1985 | Japan . | |
| 144377 | 7/1986 | Japan . | |
| 169272 | 7/1986 | Japan | 400/248 |

OTHER PUBLICATIONS

*IBM Technical Disclosure Bulletin*; vol. 27, No. 10B, pp. 6356–6357, Mar. 1985; "Ribbon Cartridge Having Self-Induced Take-Up Motion".

Anczurowski et al, "Materials for Thermal Transfer Printing", 1984 International Printing & Graphic Arts/Testing Conference, p. 6.

*Primary Examiner*—David A. Wiecking

*Attorney, Agent, or Firm*—Fitzpatrick, Cella, Harper & Scinto

[57] ABSTRACT

A thermal transfer recording apparatus capable of image recording and image correction using a self-correction ribbon. In image recording the ribbon is lifted off from the recording sheet immediately after heating, while in correction the ribbon is lifted off with a delay from the sheet so that the ribbon develops sufficient adhesive force by cooling. The delay is caused by a lever member or the like, movable between a protruding position for correction and a retracted position for recording, and provided on an ink ribbon cassette or on the recording apparatus itself.

47 Claims, 21 Drawing Sheets

IMAGE RECORDING APPARATUS AND INK SHEET CASSETTE APPLICABLE THEREIN

This application is a continuation of application Ser. No. 501,437 filed Mar. 22, 1990, now abandoned, which is a continuation of application Ser. No. 015,141 filed Feb. 17, 1987, now abandoned.

BACKGROUND OF THE INVENTION

1. Field of the Invention

The present invention relates to an image recording apparatus adapted for use in an electronic typewriter, a facsimile apparatus, a personal computer, a word processor or the like, and an ink sheet cassette adapted for use in such image recording apparatus.

The present invention also relates to an image recording apparatus capable of employing an ink sheet allowing correction of the recorded image when required, and an ink sheet cassette housing such ink sheet and adapted to be loaded in the image recording apparatus.

2. Related Background Art

A conventional recording apparatus, capable of correcting the recorded image according to correcting information, is equipped with a correcting ribbon in addition to a recording ink ribbon.

When performing such correction, the recording ink ribbon has to be retracted from the recording position, and the correcting ribbon is brought to the recording position by means of an upward or downward rotation. Because of this operation, conventional recording apparatus are inevitably large.

SUMMARY OF THE INVENTION

An object of the present invention is to provide an image recording apparatus capable of providing a sharp recorded image and securely lifting off an erroneously recorded image, and an ink sheet cassette adapted for use in such image recording apparatus.

Another object of the present invention is to provide a compact image recording apparatus and an ink sheet cassette adapted for use in the image recording apparatus.

Still another object of the present invention is to provide an image recording apparatus employing an ink sheet usable both for image recording and for correction of erroneous recording, and an ink sheet cassette adapted for use in such an image recording apparatus.

DETAILED DESCRIPTION OF THE PREFERRED EMBODIMENTS

Now the present invention will be explained in detail with reference to the preferred embodiments thereof shown in the attached drawings.

At first there will be given an explanation on an ink sheet employed in the present invention. The ink sheet, formed as an ink ribbon, is a so-called self-correction ribbon, which is capable not only of providing a recorded image according to recording information, but also of correcting the recorded image by peeling or lifting off the ink deposited on a recording medium.

Figure 1:
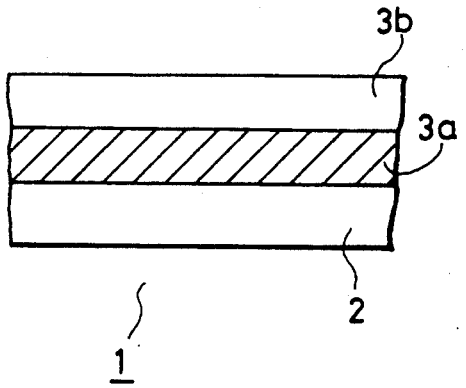
FIG. 1 is a vertical cross-sectional view of a correctable ink ribbon employable in an embodiment of the present invention.

FIG. 1 is a cross-sectional view of an ink ribbon 1 applicable in the present invention.

The ink ribbon 1 is composed of a substrate sheet 2, and an intermediate ink layer 3*a* and a surface layer 3*b* formed thereon. As will be explained later in more detail, the intermediate ink layer 3*a* is composed of thermoplastic resin containing a coloring material such as carbon black or dyes, while the surface layer 3*b* is composed of transparent wax-type resin.

The substrate 2 can be composed of already known film or paper. Preferred examples are plastic films of a relatively high heat resistance, such as polyester, polycarbonate, triacetyl cellulose or polyimide, or papers such as cellophane, sulfuric acid-treated paper or condenser paper. The thickness of substrate 2 is preferably in a range of 1 to 15 μm in case a thermal head is to be employed as the heat source for thermal transfer, but is not limited in case a heat source capable of selectively heating the ink layer, such as a laser beam, is to be employed.

For forming a recording, the intermediate ink layer 3*a* has to be easily peelable from the substrate 2, when there is a long time between the application of thermal energy to the intermediate ink layer 3*a* and the separation of the substrate 2 from a recording material such as recording paper or a plastic sheet for overhead projector, i.e. namely when the ink ribbon 1 and the recording material are maintained in face-to-face contact, and subjected to heat application, and the ink ribbon 1 is cooled considerably by the movement of the thermal head.

For this reason the intermediate ink layer 3*a* contains not only a heat-fusible binder such as natural wax, petroleum wax or synthetic wax, but also oily substances such as polyolefin resin, polyamide resin, polyester resin, epoxy resin, polyurethane resin, polyacrylic resin, polyvinyl chloride resin, cellulose resin, polyvinyl alcohol resin, petroleum resin, phenolic resin, polystyrene resin, polyvinyl acetate resin, an elastomer such as natural rubber, styrenebutadiene rubber, isoprene rubber or chloroprene rubber, polyisobutylene, polybutene, plasticizers, mineral oil or vegetable oil, in such a manner as to have a fusing temperature of ca. 50° to 100° C. in the entire ink layer including the coloring material and other eventual additives.

The transparent surface layer 3*b* is required to be softened upon heating by the thermal head and to firmly adhere to the recording material, and to hardly mix, in the fused state, with the intermediate ink layer 3*a*. For this reason, the heat-fusible binder should preferably be composed of at least 50% of the above-mentioned resins and the above-mentioned waxes, plasticizers, mineral or vegetable oils should have a melting temperature of ca. 50° to 100° C. in the entire transparent layer. Also for improving the breakage of the surface layer 3*b*, layer 3*b* may be formed in the form of dots or with surface irregularities.

The thickness of the intermediate ink layer 3*a* is preferably in a range from 0.5 to 10 μ, and the thickness of the entire thermal transfer ink layer 3 (including the intermediate ink layer 3*a* and the transparent surface layer 3*b*) is preferably in a range from 2 to 20 μm.

As the coloring material there can be employed various dyes and pigments known in the field of printing. The percentage of the coloring material in the intermediate layer 3*a* is advantageously in a range from 1 to 80%. The intermediate layer 3*a* and the surface layer 3*b* may further contain additives such as dispersant or filler composed of powdered metal, powdered inorganic material or powdered metal oxide.

The intermediate layer 3*a* and the surface layer 3*b* are preferably composed of materials that are mutually insoluble, but their mutual separation is still possible by the difference in the viscosity in the fused state, even if the materials are mutually soluble.

In the following there will be explained an electronic typewriter, as an example of the recording apparatus capable of obtaining a recorded image according to recording information and correcting erroneous recording by means of the above-explained ink ribbon.

In the following embodiment, image recording by ink deposition onto the recording material and correction of erroneous recording by the lifting-off of the thus deposited ink are rendered possible by peeling the ink sheet from the recording material within a short time after the application of thermal energy to the ink sheet, or peeling the ink sheet after a cooling step thereof.

Figure 2:
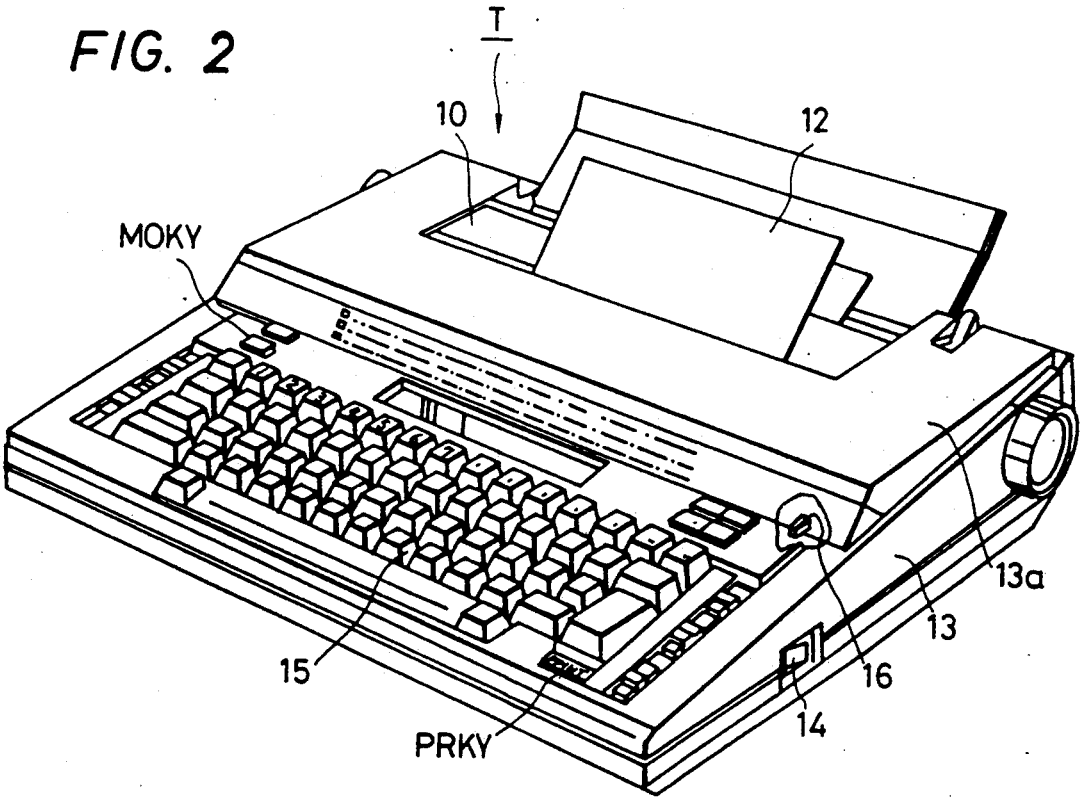
FIG. 2 is an external perspective view of a typewriter constituting an embodiment of the present invention.

FIG. 2 is an external perspective view of a typewriter T constituting an information output apparatus in which an embodiment of the present invention is applied.

In FIG. 2 there are shown a platen 10, a recording sheet 12, a casing 13, a power switch 14 for turning on and off the power supply, a keyboard 15, and a hood switch 16 which is actuated by a hood 13*a*, and which detects the open or closed state thereof, and, when hood 13*a* is opened, generates a signal for shifting the ink ribbon to a predetermined position and for locking the keyboard. A mode key (1) MOKY is used for setting various modes such as ribbon modes to be explained later. A print instruction key PRKY provides a print instruction. The above-mentioned typewriter T is provided with a printer unit, an input unit, a display unit, a control unit and an external input-output interface, but the input unit and display unit may naturally be dispensed with in the present embodiment.

Figure 3:
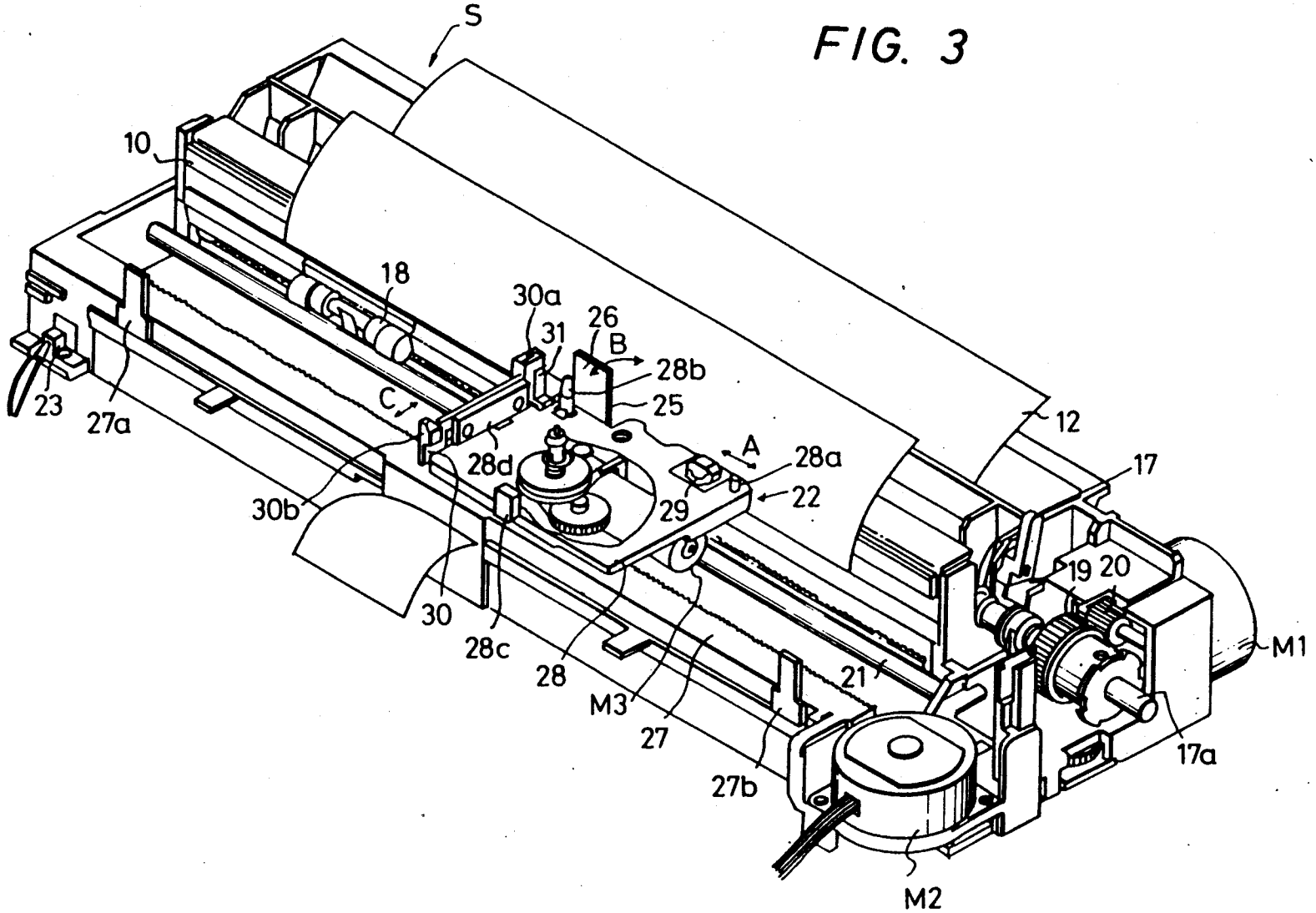
FIGS. 3 and 4 are perspective views of a recording unit embodying the present invention.
Figure 4:
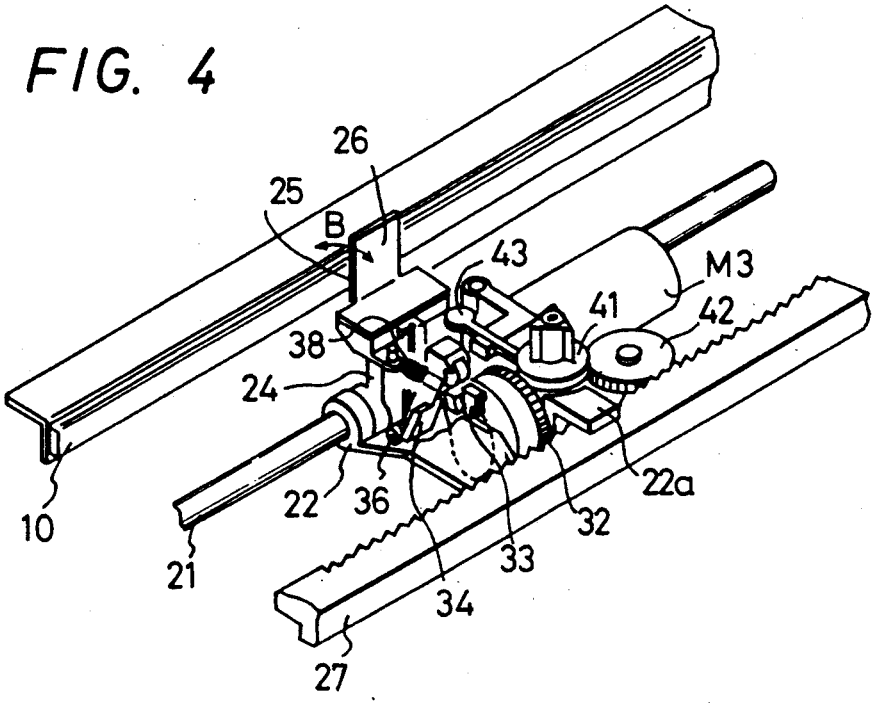

FIGS. 3 and 4 are perspective views of the recording unit embodying the present invention.

A recording sheet 12 is supported by the platen 10 and is maintained in pressure contact with an unrepresented portion of a sheet feed roller 17 by means of a pinch roller 18. The shaft 17*a* of said sheet feed roller 17 has a gear 19, which is linked with a sheet feed motor M1 through a reducing gear 20. Thus the sheet feed motor M1 rotates the sheet feed roller 17 to advance the recording sheet 12. The platen 10 maintains the recording sheet 12 in position, when a thermal head 25 executes a recording operation by pressing the recording sheet 12 across the ink ribbon.

In the following there will be explained how a carrier 22 executes a reciprocating motion.

A shaft 21, provided in front of the platen 10 and parallel thereto, supports a carrier 22 (FIG. 6) movably in a direction A. Thus the carrier 22 is capable of reciprocating along the transport path S of the recording sheet 12.

A belt is extended between two unrepresented pulleys and is fixed, in a part thereof, to carrier 22. The unrepresented pulleys are linked, through unrepresented gears, to a carrier motor M2, which causes the reciprocating motion of the carrier 22 in the direction A along the shaft 21, through the unrepresented pulleys and the belt. A limit sensor 23 for detecting the position of the carrier 22 is provided at a lateral end close to a home position.

The carrier 22 supports a head holder 24 (FIG. 4) rotatably about the shaft 21. Head holder 24 is provided with a heat sink 26 on which the thermal head 25 is mounted. Carrier 22 is supported and guided, through an integral guide portion 22*a*, by a rack 27, which is provided with projections 27*a*, 27*b* at the ends thereof.

Carrier 22 is further provided with a carrier table 28 for accepting an ink ribbon cassette 50 (FIG. 9), and carrier table 28 is provided with a sensor 29 for detecting the presence or absence of cassette 50, type thereof, and the end of the ink ribbon 1. Carrier table 28 supports a link lever 30 movably along a guide 28*d* and in a direction C perpendicular to the platen 10. Link lever 30 is a moveable element lever 30 engages with a link member 31 mounted on the heat sink 26. The rotation of the heat sink 26 in a direction B toward or away from the platen 10 causes a movement of the lever 30 in a direction C toward or away from the platen 10. Link lever 30 is provided with an index mark 30*a* which allows the operator to visually confirm the next print position. Link lever 30 is provided, at the rear end thereof, with an engaging portion 30*b* which, upon engaging with a switch lever 62 of the cassette 50 to be explained later, elevates lever 62 toward the platen 10.

In the present embodiment, as explained above, the index mark 30*a* is provided on the link lever 30 which is close to the thermal head 25 and is related to the control of the peeling condition, so that the thermal head needs only to be moved to the position of index mark 30*a* for making a recording at the position of index mark 30*a*. In this manner the presence of the index mark does not reduce the recording speed or cause any other drawbacks such as noise.

In the following there will be explained the method of detachably mounting the cassette 50 on carrier table 28. Carrier table 28 is provided with fixed pins 28*a*, 28*b* on an upper face thereof and an elastic hook 28*c* on a lateral face thereof. Thus the cassette 50 can be detachably mounted on the carrier table 28, by engaging apertures 52*h*, 52*i* of a lower cassette case 52 of the cassette 50 (FIG. 10) with pins 28*a*, 28*b* and elastically engaging an engaging portion 52*j* of lower cassette case 52 with hook 28*c*. Carrier table 28 can naturally house not only a recording/correcting ribbon cassette but also an ordinary single-color ribbon cassette.

In the following there will be explained an up-down mechanism for the thermal head 25.

FIGS. 5 to 8 illustrate an embodiment of the mechanism for contacting (down position) and separating (up position) the thermal head 25 and for taking up the ribbon.

The carrier 22 is equipped with an up-down motor M3, the rotation of which is transmitted through unrepresented gears and a reducing gear 31 to a gear 32*a* to rotate an associated cam 32. Cam 32 is provided with a projection 32*b* which engages with a stopper 33 provided on the carrier 22 to limit the rotation of the cam 32, when it is rotated clockwise in a direction D1 shown in FIG. 7 or counter-clockwise in a direction D2 shown in FIG. 8. Stopper 33 is formed by an elastic material such as rubber for reducing the contact shock with the cam 32.

Figure 6:
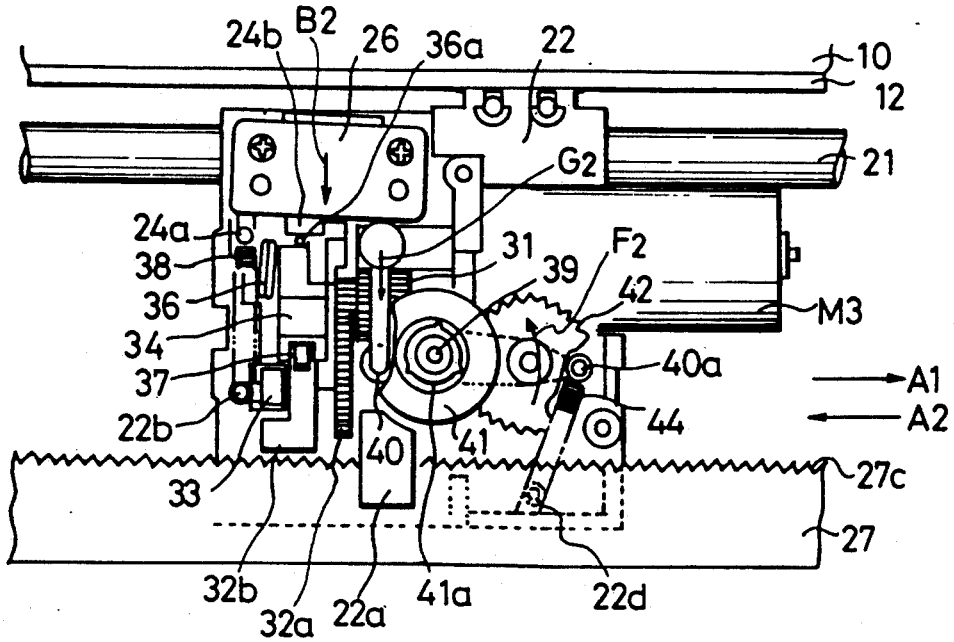
Figure 8:
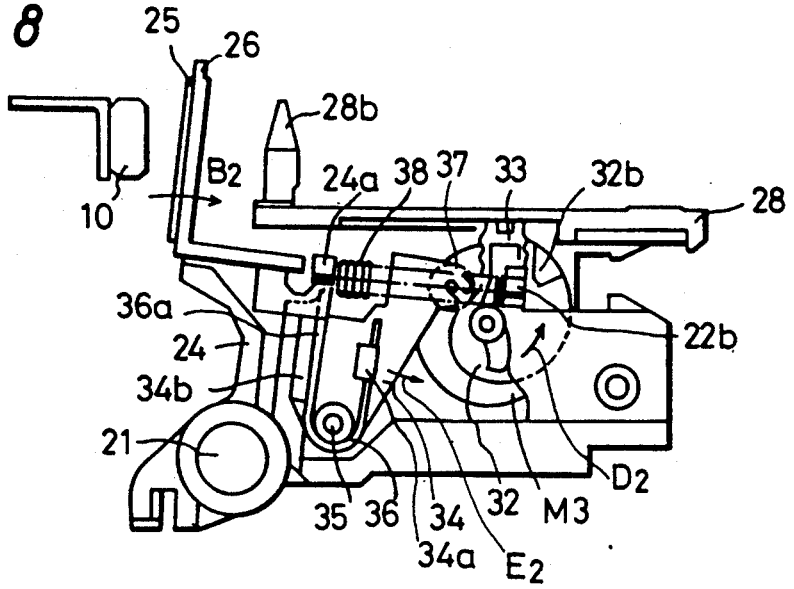

An up-down lever 34 is provided on the carrier 22, rotatably about a shaft 35 (FIG. 8). Between projections 34*a*, 34*b* of up-down lever 34, there is mounted a torsion coil spring 36 in a charged state. The up-down lever 34 supports, at an end thereof, a roller 37 in rotatable manner. A head returning spring 38 is provided between a spring support 24*a* of the head holder 24 and a spring support 22*b* of the carrier 22 to bias head holder 24 in a direction B2 away from the platen 10 (FIGS. 6 and 8). The biasing force of head return spring 38 is transmitted, from a contact portion 24*b* of the head holder 24, through an arm 36*a* of the torsion coil spring 36, to the up-down lever 34. Consequently the up-down lever 34 is biased, by the head return spring 38, in a direction B2 away from the platen 10 (FIG. 8), and the roller 37 provided on up-down lever 34 is maintained in pressure contact with the cam 32.

Consequently the head 25 is rotated toward the platen 10 by the rotation of the motor M3.

In the following there will be explained a take-up mechanism for the ink ribbon 1.

The carrier 22 is provided with a take-up shaft 39, which rotatably supports a take-up lever 40 and a take-up clutch 41 positioned above lever 40. Also the take-up lever 40 rotatably supports a take-up gear 42, whereby an unrepresented gear portion of the take-up clutch 41 constitutes a sun gear while the take-up gear constitutes a planet gear.

In a guide portion 22*c* of the carrier 22 there is provided a take-up switch lever 43 movable in directions G1 (FIG. 5) and G2 (FIG. 6), and an end of take-up switch lever 43 engages with the take-up lever 40. Between a spring support 40*a* of the take-up lever 40 and a spring support 22*d* of the carrier 22 there is provided a take-up lever pressing spring 44 for biasing the take-up lever in a direction F1. The biasing force of take-up lever pressing spring 44 is transmitted through the take-up lever 40 to the take-up switch lever 43 to bias the same in a direction G1 and to maintain the same in pressure contact with the heat sink 26. Take-up clutch 41 is provided with a hub receiver 41*a* engageable with a take-up hub 55 of the cassette 50.

Also between the hub receiver 41*a* and an unrepresented gear of the take-up clutch 41 there is provided an unrepresented friction clutch for transmitting the rotation of the unrepresented gear to the hub receiver 41*a*.

In the following there will be explained the function of head contact (down position), head separation (up position) and ribbon take-up in the above-explained mechanism.

Figure 5:
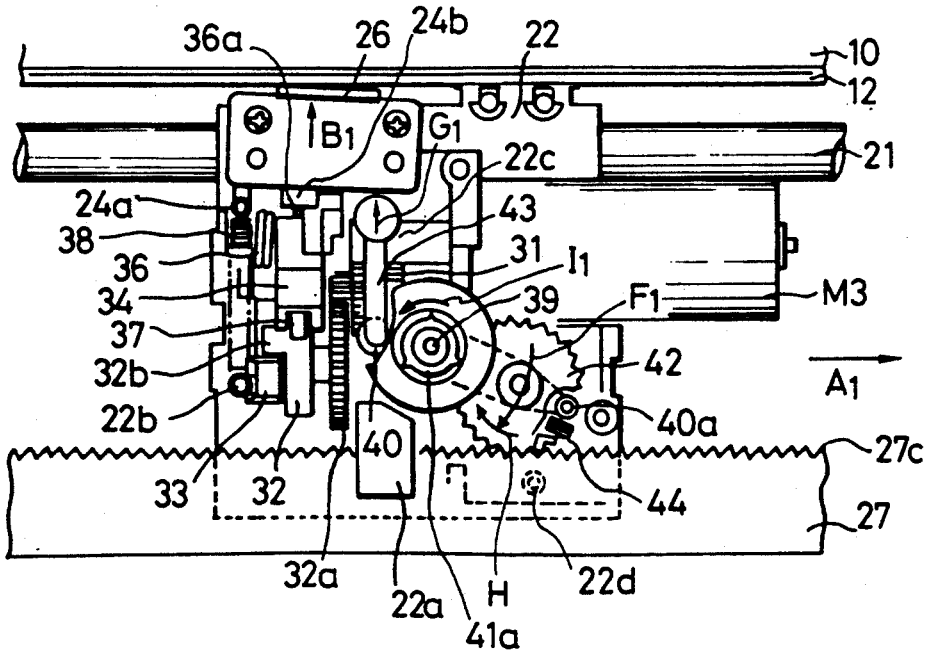
FIGS. 5 and 6 are plan views showing a head rotating mechanism and a ribbon take-up mechanism of the present invention.
Figure 7:
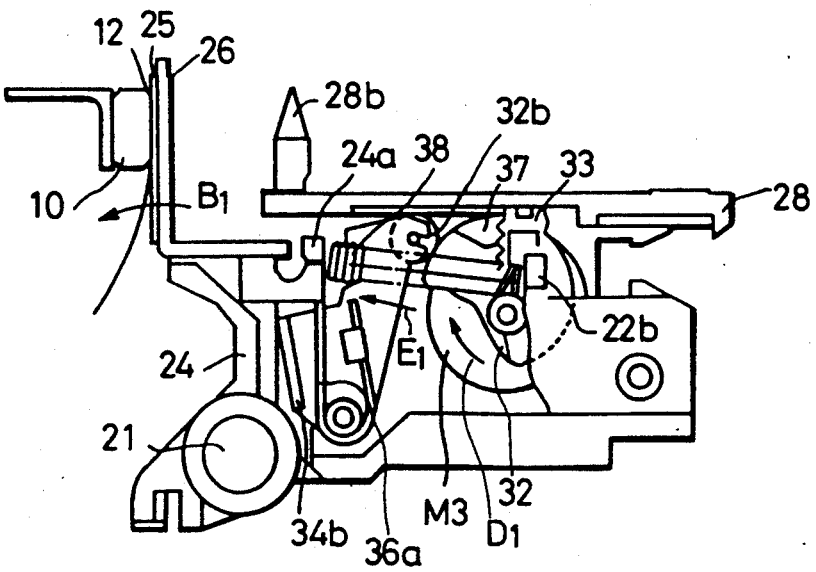
FIGS. 7 and 8 are lateral views thereof.

FIGS. 5 and 7 illustrate a head contact state (down position) in which the ribbon can be taken up. The up-down motor M3 is activated clockwise to rotate the cam 32 in a direction D1 (FIG. 7) through the reducing gear 31, thus bringing the projection 32*b* of the cam 32 into contact with the stopper 33.

The clockwise rotation of the cam 32 in the direction D1 (FIG. 7) increases the radius thereof at the contact point of the roller 37 provided on the up-down lever 34, whereby the up-down lever 34 rotates counter-clockwise in the direction E1 (FIG. 7) against the biasing force of the head return spring 38. This rotation of the up-down lever 34 is transmitted, through the arm 36*a* of the torsion coil spring 36 provided on the up-down lever 34 to the contact portion 24*b* of the head holder 24 to rotate the same counter-clockwise in the direction B1 (FIG. 7). Consequently the thermal head 25, mounted on the heat sink 26 on the head holder 24 is pressed to the platen 10 across the recording sheet 12. Thus, at the recording operation by the thermal head 25, it is maintained in contact with the recording sheet 12 which is supported by the platen 10.

After the thermal head 25 is brought into contact with the platen 10, the radius of the cam 32 continues to increase, thereby further rotating the up-down lever 34 counter-clockwise in the direction E1 (FIG. 7). In this state, the movement of the head holder 24 is limited since the thermal head 25 is already in contact with the platen 10. Consequently, the movement of the arm 36*a* of the torsion coil spring 36, maintained in contact with the contact portion 24*b* of the head holder 24, is also limited. Thus the counter-clockwise rotation of the up-down lever 34 in the direction E1 (FIG. 7) causes the torsion spring 36 to leave the projection 34*b* of the up-down lever 34, whereby an additional spring force is stored in the spring 36. The biasing force of the torsion coil spring 36 is now transmitted to the contact portion 24*b* of the head holder 24, since the projection 34*b* of the up-down lever 34 is no longer in contact with the arm 36*a* of the torsion coil spring 36, thereby pressing the thermal head 25 against the platen 10 across the recording sheet 12.

When the projection 32*b* of the cam 32 is in contact with the stopper 33 as shown in FIG. 7, the thermal head 25 is pressed against the platen 10 with a predetermined pressure In the following there will be explained the function of the ribbon take-up mechanism for winding the ink ribbon 1.

With the movement of the heat sink 26 on the head holder 24 toward the platen 10 in the direction B1, the take-up switch lever 43 moves in the direction G1 by the force of the take-up lever pressing spring 44. Consequently the take-up lever 40 rotates in the direction F1, whereby the take-up gear 42 provided thereon meshes with teeth 27*c* provided on the rack 27. When the thermal head 25 is pressed against the platen 10, the movement of the take-up lever 40 is limited by the contact position of the take-up gear 42 and the rack 27, whereby the take-up gear 42 is biased toward the rack 27 by the take-up lever pressing spring 44 Thus a movement of the carrier 22 in the recording direction A1 causes a clockwise rotation of the take-up gear 42 in the direction H1, and this rotation is transmitted to the take-up clutch 41, whereby the hub receiver 41*a* rotates counter-clockwise in a direction I1.

Thus, when the cassette 50 is mounted on the carrier table 28, the ink ribbon 1 in the cassette can be taken up by engaging a take-up hub 55 of the cassette 50 with hub receiver 41*a*.

In the following there will be explained a separating operation (up position) of the head 25 from the platen 10. FIGS. 6 and 8 illustrate a separated state (up position) of the head, wherein the ribbon take-up is disabled.

The up-down motor M3 is activated counter-clockwise to rotate the cam 32 in the direction D2 (FIG. 8) through the reducing gear 31, thereby bringing the projection 32*b* of the cam 32 into contact with the stopper 33. The rotation of the cam 32 in the direction D2 reduces the radius of the cam 32 at the contact point of the roller 37 provided on the up-down lever 34. Thus the up-down lever 34 rotates in the direction E2 (FIG. 8) by the biasing force of the head return spring 38 to move the head holder 24 in the direction B2, whereby the heat sink 26 and the thermal head 25 mounted on the head holder 24 are separated from the platen 10 Also the movement of the heat sink 26 in the direction B2 moves the take-up switch lever 43 in the direction G2, whereby the lever rotates the take-up lever 40 in the direction F2 against the biasing force of the take-up lever pressing spring 44 to separate the take-up gear 42 from the rack 27.

In this non-recording state in which the head 25 is separated from the platen 10, the hub receiver 41*a* of the take-up clutch 41 does not rotate when the carrier 22 is moved along the shaft 21 in the direction A1 or A2, so that the ink ribbon is not taken up. Thus the ink ribbon 1 is not wound also in case a switch lever 62 (to be explained later) and a peeling roller 54 are separated from the platen 10, as will be explained later, in relation to the thermal head 25.

The biasing force of the head return spring 38 is so selected as to be insufficient for charging the torsion coil spring 36 but capable of working against the take-up lever pressing spring, so that the positions of the thermal head 25 and of the take-up gear 42 are determined by the radius of the cam 32.

The up-down motor M3 may be activated for a period necessary and sufficient for the rotation of the cam 32, or may be stopped upon detection of a current change in motor M3 upon contact of the projection 32*b* with the stopper 33, or may be controlled by an unrepresented sensor for detecting the position of the cam 32.

The head 25 as well as the switch lever and the peeling roller are separated from the platen 10 in case the carrier 22 returns to the home position, in the presence of a gap of a certain size in the image to be recorded (so-called skipping), or partial recording, and the unnecessary wasting of the ink sheet can be prevented since the ink ribbon is not taken up in these cases.

Figure 9:
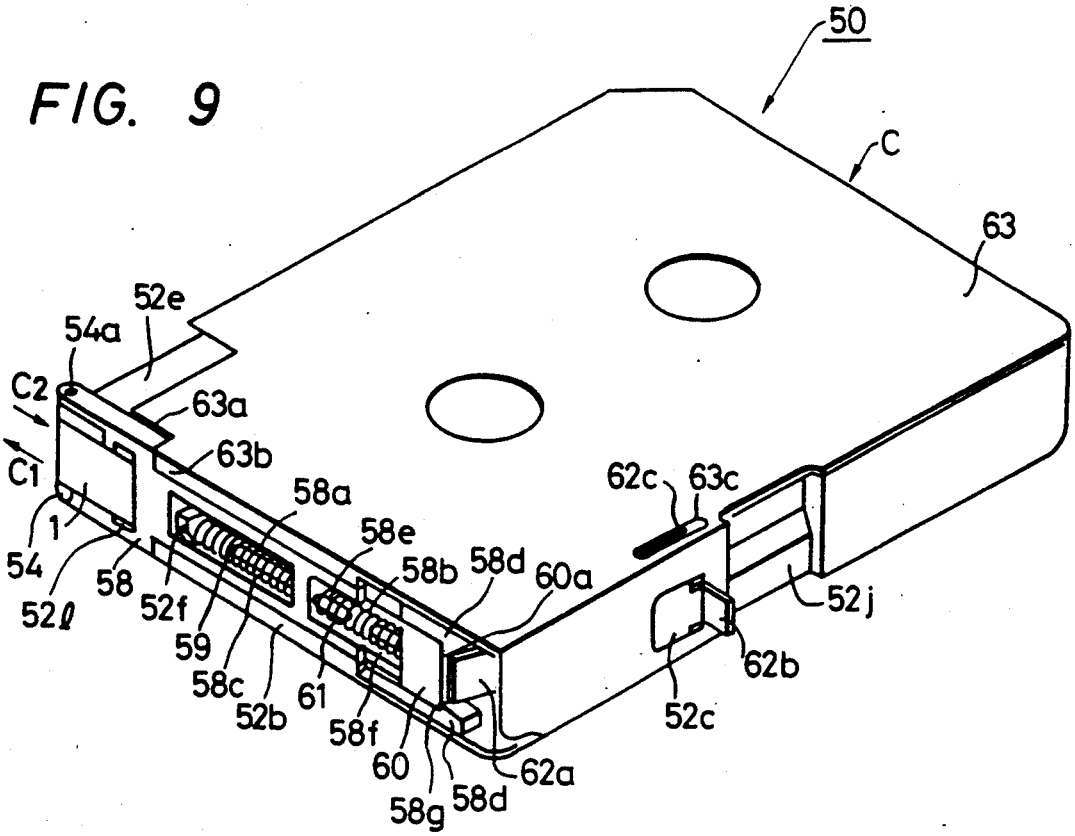
FIG. 9 is an external perspective view of a correctable ink ribbon cassette of the present invention.
Figure 10:
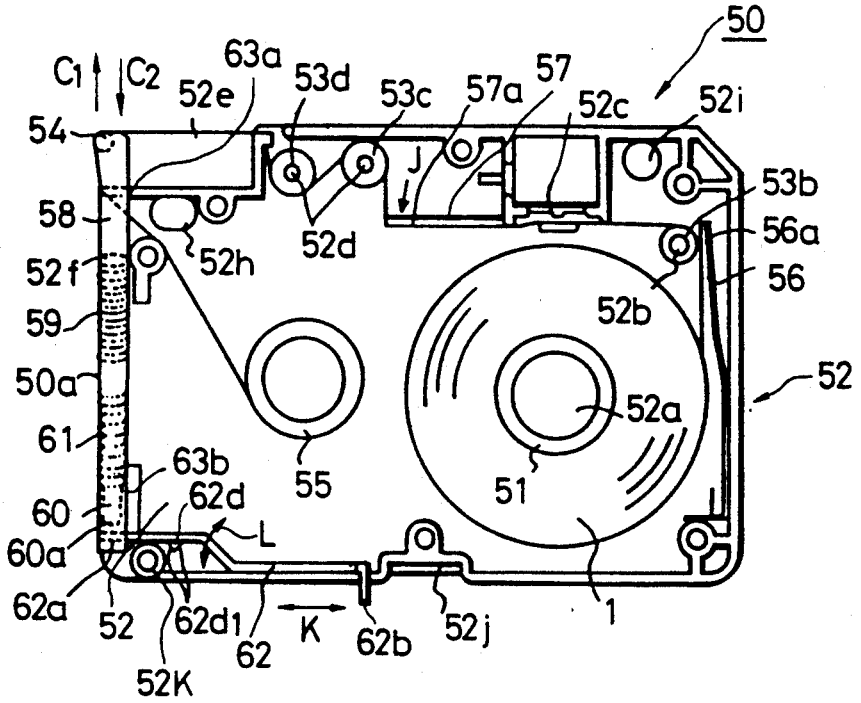
FIG. 10 is a plan view of the interior thereof.

Now reference is made to FIGS. 9 and 10 for explaining the ink ribbon cassette.

The aforementioned ink ribbon cassette 50 houses the ink ribbon 1 in a case c composed of a lower case 52 and an upper case 63, and is detachably mounted on the carrier table 28.

The ink ribbon 1 is wound on a core 51 which is fitted on a projection 52*a* of the lower case 52. Ink ribbon 1 is guided through rollers 53*b*, 53*c*, 53*d* rotatably mounted on a projection 52*b* of the lower case 52, an ink ribbon detecting window 52*c* and a projection 52*d* of the lower case, then exposed to the outside of the case c through an aperture 52*e*, then guided by the peeling roller 54, again introduced into the case c through an aperture 52 l, and finally taken up by the take-up hub 55.

When cassette 50 is loaded in a predetermined position on the table 28, aperture 52*e* is positioned corresponding to the head 25, so that the ink ribbon exposed outside the cassette case c can be heated by the thermal head which generates heat corresponding to the recording information. More specifically heat generation is conducted by a heat generating portion 25*a* composed of plural heat generating members. Ink ribbon 1 is biased to the roller 53*b* by means of a press spring 56 which is provided on the lower case 52 and bears a felt member 56*a* for preventing damage to the ink ribbon 1.

A tension spring 57 biases the ink ribbon in a direction J to take up the slack therein. Tension spring 57 is mounted on the lower case 52 and elastically presses the ink ribbon 1 at the upstream side of the rollers 53*c*, 53*d* with respect to the moving direction of the ink ribbon 1. Thus, if the ink ribbon 1 becomes slack due to a change in the course thereof induced by the movement of the peeling lever 58 and of the peeling roller 54, the slack can be rapidly absorbed by the elastic force of the tension spring. Also tension spring 57 is provided with a felt pad 57*a* on the contact face with the ink ribbon 1 for preventing eventual damage therein. The felt pad may be replaced by a suitable coating provided on the surface of the tension spring 57.

The peeling lever 58 is rendered slidable in the direction C1 or C2, along a lateral end 50*a* of the cassette 50 having the aperture 52*e*. More specifically the lever 58 is guided at the front end, by an end portion 63*a* and a guide portion of the upper case 63 and by an unrepresented end portion and an unrepresented guide portion of the lower case 52, and, at the rear end, by a downward bent portion 63*b* of the upper case 63 and an upward bent portion 52*b* of the lower case 52. The aforementioned peeling roller 54 is rotatably mounted on a shaft 54*a* positioned at the front end of lever 58. The lever 58 is further provided with an upper aperture 58*a* and a lower aperture 58*b*. In the upper aperture 58*a* there is fitted a projection 52*f* of the lower case, and a return spring 59 is provided between said projection 52*f* and the lever 58, along a guide rod 58*c*. Consequently the lever 58 is constantly biased downwards (direction C2) by spring 59. In the lower aperture 58*b*, there is provided a slider 60 which is rendered slidable with respect to the lever 58, along a guide 58*d*. Also in the lower aperture 58*b* there is provided a compression spring 61 between the lever 58 and the slider 60, along a guide rod fixed to the lever 58 and a guide rod 58*f* fixed to the slider 60, whereby the slider 60 is biased downwards in the direction C2 and is stopped by a stopper 58*g* of the guide 58*d*.

A switch lever 62 engages, at an end 62*a* thereof, with the lower end 60*a* of the slider 60, and is provided slidably in the direction K and rotatably in the direction L between the lower case 52 and the upper case 63. At the rear end, switch lever 62 has a bent switching portion 62*b* which engages with the aforementioned projections 27*a*, 27*b* of the main body for moving the lever 62 in the direction K. The moving range of lever 62 is limited by the lateral ends of the aperture 52*c*. Also the lever 62 can rotate about a projection 62*c*, engaging with a slot 63*c* provided in the lower and upper cases 52, 63.

In the vicinity of an end, the lever 62 is provided with a projection 62*d* for preventing unexpected lateral movement of the lever 62. However projection 62*d* has a slanted face 62*dl* in order not to hinder lateral movement of the lever 62 in case the switching portion 62*b* engages with the projections 27*a*, 27*b*. Consequently the projection 62*d* can go over the roller 52*k* only with a slight force at the movement of the lever 62.

In the above-explained cassette 50, the projection 27*b* of the apparatus engages with the switching portion 62*b* to move the lever 62 to left, whereby the end 62*a* thereof protrudes from the cassette end 50*a* and is brought to a position capable of engaging with the engaging portion 30*b* of the apparatus. Thus, when the link lever 30 moves toward the platen 10 by the rotation of the motor M3 as explained before, the engaging portion 30*b* engages with end portion 62*a* to push the lever 62 toward the platen 10. Against the biasing force of the return spring 59, the lever 62 pushes the lever 58 toward the platen 10 in the direction Cl. After the lever 58 is brought into contact with the platen 10 across the ink ribbon 1 and the recording sheet 12, the slider 60 is pushed toward the platen 10 in the direction Cl against the biasing force of the spring 61, and the lever 58 is maintained in pressure contact with the platen 10 by the biasing force of the spring 61.

Consequently the recording sheet 12 and the ink ribbon 1 after heating run together to the peeling roller 54 and are mutually separated thereafter.

In the present embodiment, the switch lever 62 brings the peeling roller 54 in contact with the platen 10 only with a low pressure through the function of the spring 61. Consequently the peeling roller 54 contacts the platen 10 with a stable elastic force, thereby preventing the occurrence of a stain on the recorded image by the ink offsetting, or defective ink ribbon feeding such as wrinkle formation or skewed feeding.

On the other hand, when the projection 27*a* of the apparatus engages with the switching portion 62*b*, the lever 62 is moved to right to retract the end portion 62*a* into the cassette end 50*a*, whereby the lever 60 is not pushed and remains separated from the platen 10 by the biasing force of the return spring 59 when the link lever 30 is moved toward the platen 10. Consequently the peeling roller 54 remains separated from the platen 10, so that the recording sheet and the ink sheet 1 are separated each other soon after the heating, or after leaving the thermal head 25.

Figure 11:
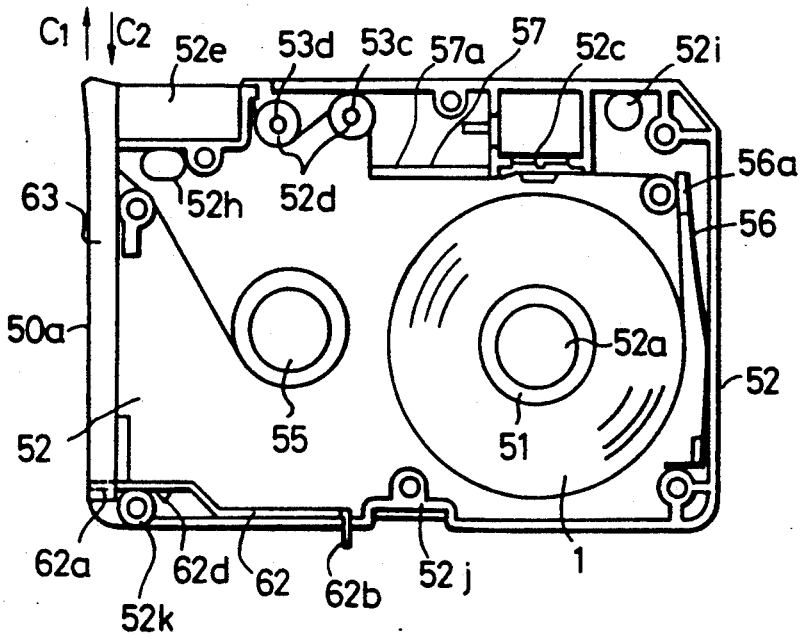
FIG. 11 is an external plan view of another embodiment of the correctable ink ribbon cassette of the present invention.

FIG. 11 shows another embodiment of the ink ribbon cassette, wherein the aforementioned peeling lever 58, peeling roller 54, return spring 59, slider 60 and spring 61 are replaced by an integral contact lever 63.

In this embodiment, the contact lever 63 is supported by the lower case 52 and the upper case (not shown) slidably in directions C1, C2, and is moved in these directions by a switch lever 62 engaging therewith.

Thus, in the above-explained cassette, the projection 27*b* of the apparatus engages with the switching portion 62*b* to move the lever 62 to left, whereby the end portion 62*a* thereof protrudes from the cassette end 50*a* and is brought to a position capable of engaging with the engaging portion 30*b* of the apparatus. When the link lever 30 is moved toward the platen 10 by the motor M3 as explained before, the engaging portion 30*b* engages with the end portion 62*b* to push the lever 62 toward the platen 10. Lever 62 pushes the contact lever 63 to a position approximately the same as that of the thermal head 25 with respect to the platen 10, whereby the contact lever is stopped at a position in contact with or close to the platen 10.

Consequently the recording sheet 12 and the ink sheet 1, after heating, run together to the peeling roller 54, and are separated from each other thereafter.

On the other hand, when the projection 27*a* of the apparatus engages with the switching portion 62*b*, the lever 62 is moved to right to retract the end portion 62*a* thereof into the cassette end. Thus the lever 62 is not pushed and remains retracted from the platen 10 when the link lever 30 of the apparatus moves toward the platen 10. Consequently the contact lever 63 remains separated from the platen 10, and the recording sheet and the ink sheet 1 are separated soon after heating, or after passing the thermal head 25.

In the following there will be explained the switching of image recording operation and correcting (lift-off) operation in the present embodiment.

FIGS. 12 to 15 are plan views illustrating image recording and correcting operations, in which the ink ribbon cassette 50 is loaded on the carrier table 28 to enable image recording.

In the following there will be explained the method of selectively effecting image recording or image correction by means of ink ribbon cassette 50.

Figure 12:
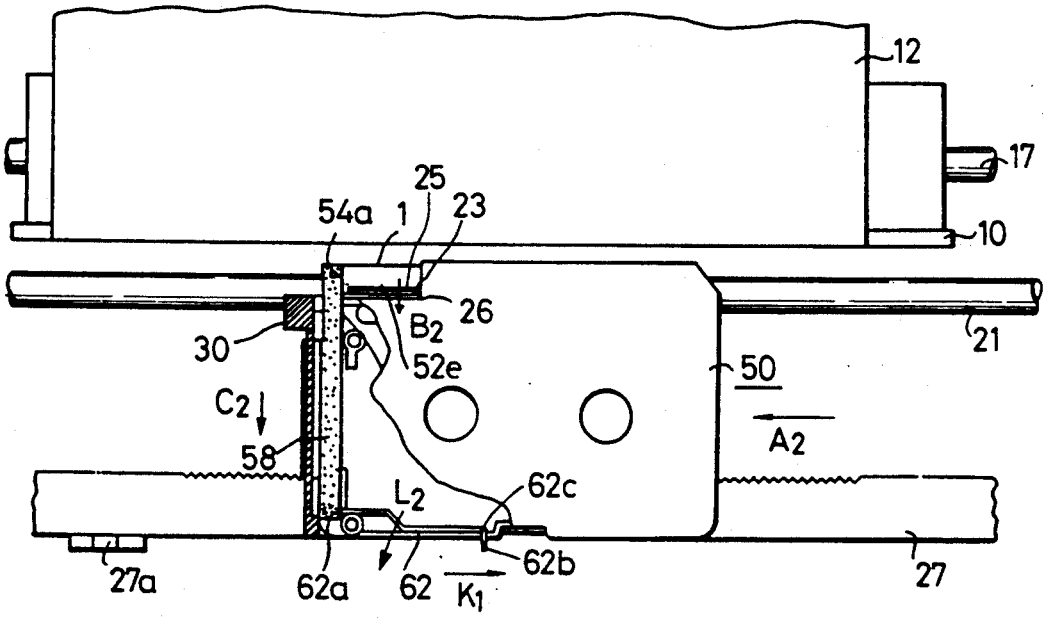
FIGS. 12 to 15 are plan views showing a switching operation of the present invention.
Figure 13:
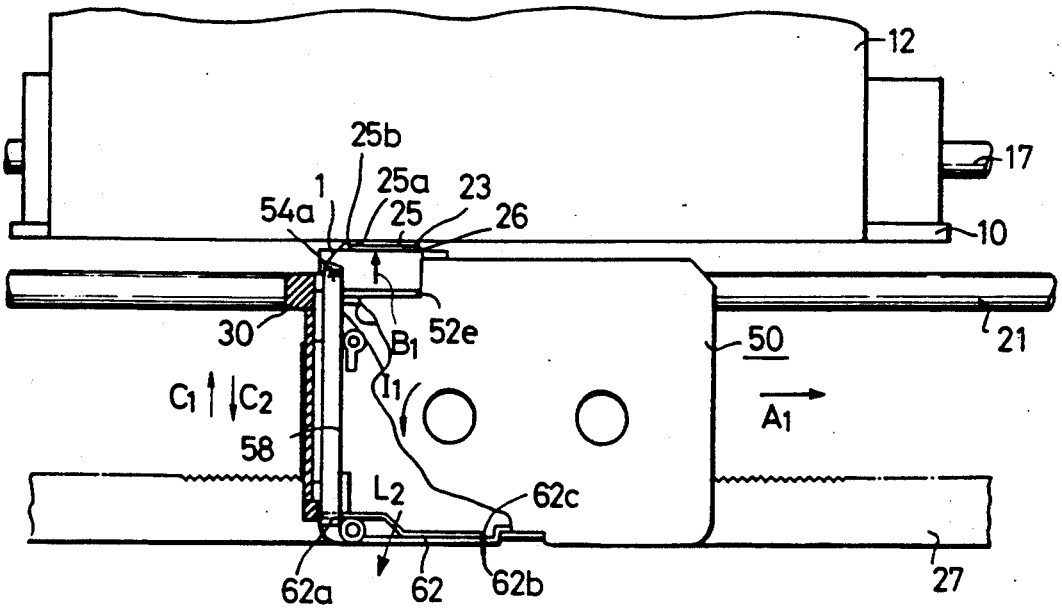

At first reference is made to FIGS. 12 and 13 showing the case of image recording by transferring both the intermediate layer 3*a* and the surface layer 3*b* of the correctable ink ribbon 1 onto the recording sheet 12, wherein FIG. 12 shows the switching operation of the cassette.

At first, in response to the reception of recording information as will be explained later, the up-down motor M3 (FIG. 6) is rotated counter-clockwise, as explained before, to move the thermal head 25 in the direction B2 away from the platen 10. Also the link lever 30 is moved in the direction C2. Then the carrier motor M2 (FIG. 3) is activated to move the carrier 22 (FIG. 6) to left or in direction A2, thereby engaging the switch portion 62*b* of the switch lever 62 with the projection 27*a* of the rack 27 and moving the switch lever 62 to right, or in the direction K1. This movement disengages the link portion 62*a* of the switch lever 62 from the link lever 30. The biasing force of the return spring 59 biases the peeling lever downwards (direction C2) and the switch lever counter-clockwise (direction L2). Consequently the peeling roller 54 is sufficiently separated from the platen 10.

FIG. 13 shows a state in which the apparatus performs image recording. In the state shown in FIG. 5, the up-down motor M3 (FIG. 6) is activated clockwise to rotate the thermal head 25 toward the platen 10 (direction B1) thereby bringing the same into contact with the platen 10 across the recording sheet 12 and the correctable ink ribbon 1. In this state, the movement of the heat sink 26 in the direction B1 displaces the link lever toward the platen 10 (direction C1). However, as explained before, the return spring 59 biases the peeling lever 58 downwards (direction C2) and the switch lever 62 counter-clockwise (direction L2), so that the peeling lever 58 is sufficiently separated from the recording sheet 12. Thus the carrier 22 is moved to right, i.e. in the recording direction Al, and the heat generating area 25*a*, consisting of plural heat generating resistors of the thermal head 25, is activated according to the recording information to heat the correctable ink ribbon 1. Immediately after this heating, the ink ribbon 1 is deflected, at the end 25*b* of the thermal head 25, by the rotation of the take-up clutch 41 and is therefore peeled off from the recording sheet 12. In this manner the intermediate layer 3*a* is transferred, together with the surface layer 3*b*, onto the recording sheet 12 to form an image of a color of the coloring material contained in intermediate layer 3*a*. The correctable ribbon 1 is subsequently taken up on the take-up core 55.

Now there will be explained the correcting operation.

Figure 14:
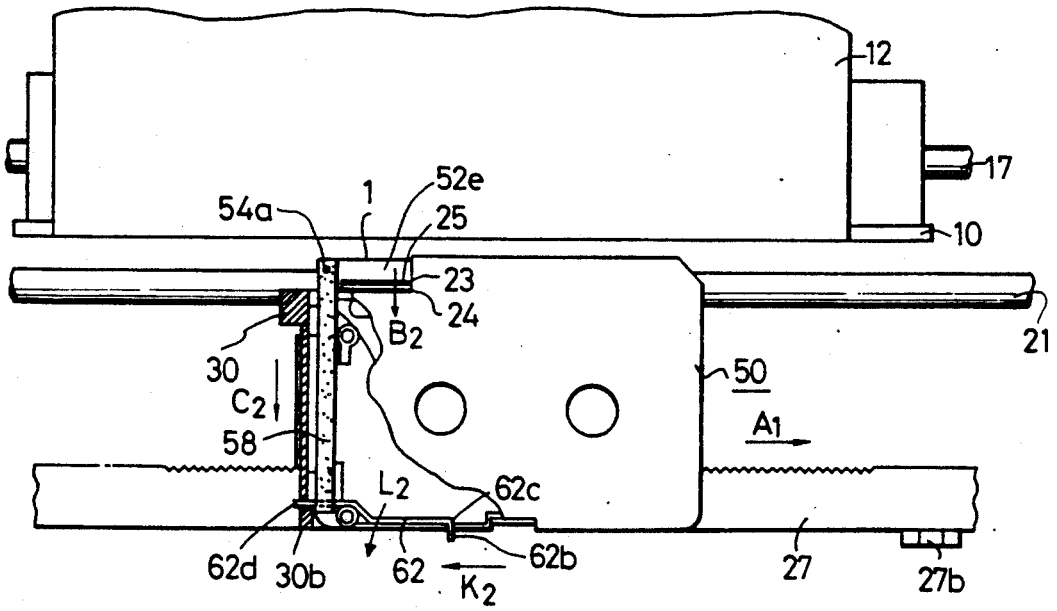
Figure 15:
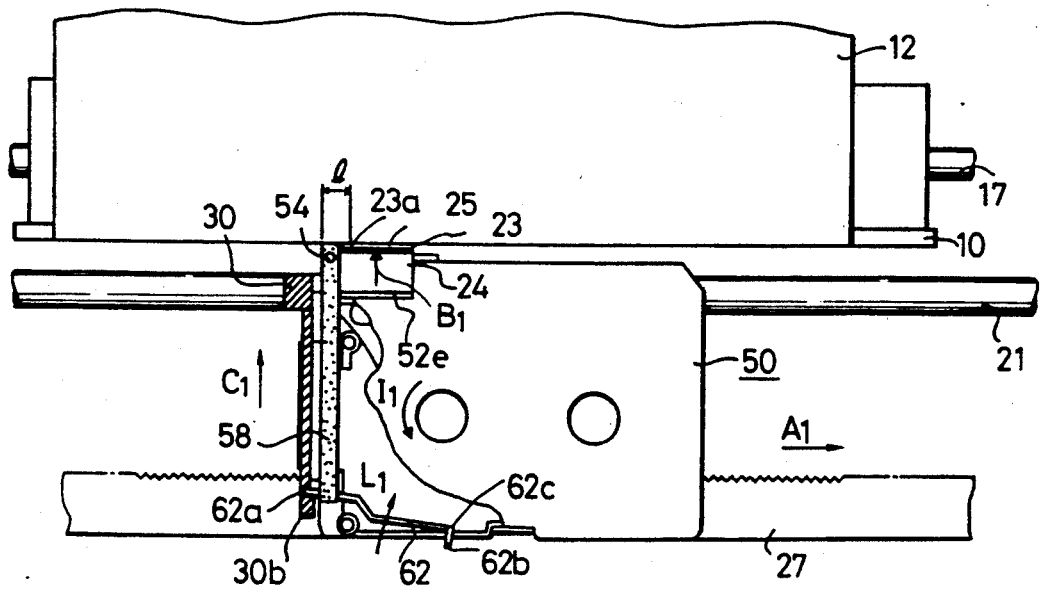

FIGS. 14 and 15 illustrate the case of correcting erroneous recording by lifting off the already deposited ink, and FIG. 16 shows the switching operation of the cassette.

At first, in response to the reception of information for correction as will be explained later, the up-down motor M3 (FIG. 6) is activated counter-clockwise as explained before to move the thermal head in the direction B2, away from the platen 10. Also the link lever 30 is moved in the direction C2. Then the carrier motor M2 (FIG. 3) is activated to move the carrier (FIG. 6) to right or in the direction A1, thereby engaging the switch portion 62*b* of the switch lever 62 with the projection 27*b* of the rack 27 and moving the switch lever 62 to left or in the direction K2. This movement of the switch lever 62 brings the link portion 62*a* thereof in engagement with the link lever 30. The return spring 59 biases the peeling lever 58 downwards (direction C2) and the switch lever 62 counter-clockwise (direction L2), so that the peeling lever is sufficiently separated from the recording sheet 12.

FIG. 15 shows a state of correcting erroneous recording by lifting off the erroneously deposited ink. As already explained in relation to FIG. 13, the up-down motor M3 (FIG. 6) is activated clockwise to rotate the thermal head 25 toward the platen 10 (direction B1) and bring the same into contact with the platen 10 across the recording sheet 12 and the correctable ink ribbon 1. In this operation, the movement of the heat sink 26 in the direction B1 displaces the link lever 30 toward the platen 10, in the direction C1. This displacement causes the engaging portion 30*b* of the link lever 30 to push up the link portion 62*a* of the switch lever 62, thereby rotating the switch lever 62 clockwise (direction L1) against the function of the return spring 59. This rotation of the switch lever 62 in direction L1 moves the peeling lever 58 upwards (direction C1) into contact with the recording sheet 12 across the ribbon 1. The link lever 30 moves further in the direction C1 to rotate the switch lever 62 in the direction L1, whereby the slider 60 is moved in the direction C1 against the function of the return spring 59 and of the spring 61. The force of spring 61 thus brings the peeling roller 54 of the peeling lever 58 in contact with the recording sheet 12 across the ink ribbon 1, or close thereto.

In this state the carrier 22 is moved to right or to the recording direction Al, and the heat generating area of the thermal head 25 is activated according to the correcting information to heat the ink ribbon 1. It is deflected by the rotation of the take-up clutch 41 in the direction I1, at the peeling roller 54 of the peeling lever 58 distanced by l from the heat-generating portion 25*a*, and is therefore peeled from the recording sheet 12. The intermediate ink layer 3*a* of the ink ribbon 1 is adhesive and lifts off the erroneously deposited ink from the recording sheet 12. Subsequently the correctable ribbon 1 is taken up on the take-up core 55.

The above-explained image recording and image correction will be further clarified, respectively by reference to the magnified schematic views shown in FIGS. 16A, 16B and FIGS. 17A, 17B.

Figure 16A:
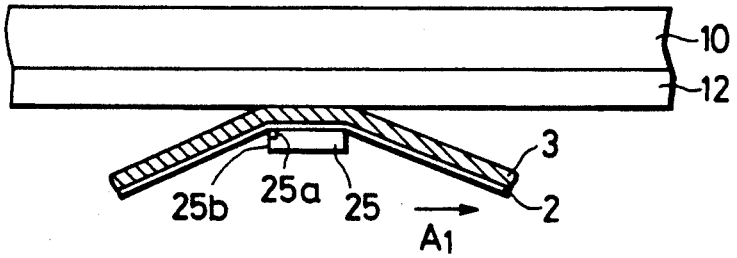
FIGS. 16A, 16B, 17A and 17B are schematic magnified views showing the function of the recording unit of the apparatus embodying the present invention.
Figure 16B:
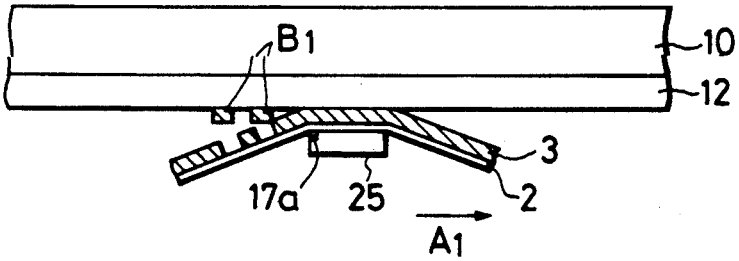

FIGS. 16A and 16B illustrate the state in which the apparatus performs image recording.

The thermal head 25 is maintained in pressure contact with the platen 10 across the correctable ink ribbon 1 and the recording sheet 12. The heat generating portion 25*a*, consisting of plural heat generating resistors of the thermal head 25, is activated according to the recording information to heat the correctable ink ribbon 1 during the movement of said thermal head 25 in the direction A1. The heat fuses the intermediate ink layer 3*a* of the correctable ink ribbon 1 according to the recording information and causes this layer to adhere to the recording sheet 12, thus forming an image.

Then the thermal head 25 is moved in the direction Al, and the ink ribbon 1 is peeled from the recording sheet 12 by deflection at the edge 25*b* of the thermal head 25 soon after said heating, i.e. before the heated ink ribbon 1 can be cooled. In this manner the ink B1 of the heated area is transferred onto the recording sheet 12 to form a recording.

Figure 17A:
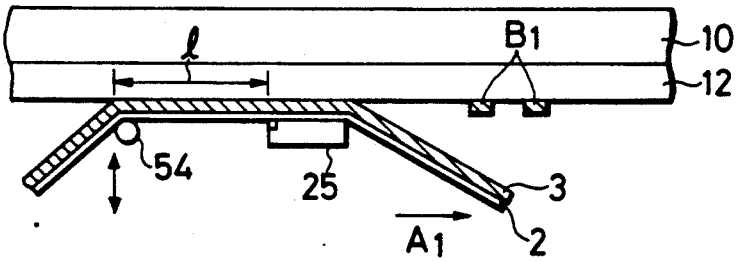
Figure 17B:
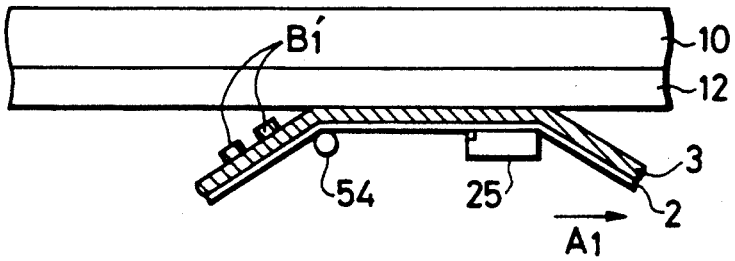

Correction of the image is conducted by lifting off the ink according to correction information, as shown in FIGS. 17A and 17B.

In the same manner as explained before, the thermal head 25 is maintained in contact with the platen 10 across the correctable ink ribbon 1 and the recording sheet 12, and the heat generating portion 25*a* of the thermal head 25 is activated at the position of ink B1 to be lifted off to heat the ink ribbon 1 during the movement of the thermal head 25 in the direction A1. The heating renders the intermediate layer 3*a* of the ink ribbon 1 adhesive. The ink ribbon 1 is maintained in contact with the recording sheet 12 by means of the peeling roller 54, at a point distanced by l from the heat generating portion 25*a* of the thermal head 25 in a direction opposite to the arrow Al (FIG. 16A). Then the thermal head 25 and the peeling roller 54 move in the direction Al while maintaining a mutual distance ( , so that the ink ribbon 1 is deflected and peeled off from the recording sheet 12 at the position of the peeling roller 54, where the ink ribbon has experienced a delay after heating and is therefore already cooled. The time to the peeling can be determined by the moving speed of the thermal head 25 and the distance l thereof. The cooling of the ink ribbon 1, which is determined by the heating with the thermal head 25 and by the time to the peeling in turn determined by the position and moving speed of the peeling roller 54, causes destruction by condensation of the intermediate ink layer 3*a*, whereby the layer firmly adheres to the substrate 2 and becomes adhesive to lift off the ink B1 deposited on the recording sheet 12. The transparent surface layer 3*b* remains on the recording sheet 12, but does not hinder subsequent recording since it is transparent.

As explained in the foregoing, the apparatus of the present embodiment is capable of image recording and image correction by peeling off the deposited ink. Such image recording and correction are rendered possible through the ink ribbon peeling at edge 25*b* of the thermal head immediately after heating, or through the movement of a distance l after heating by the thermal head, combined with the ink ribbon peeling at the roller distanced by l from the thermal head.

Figure 18:
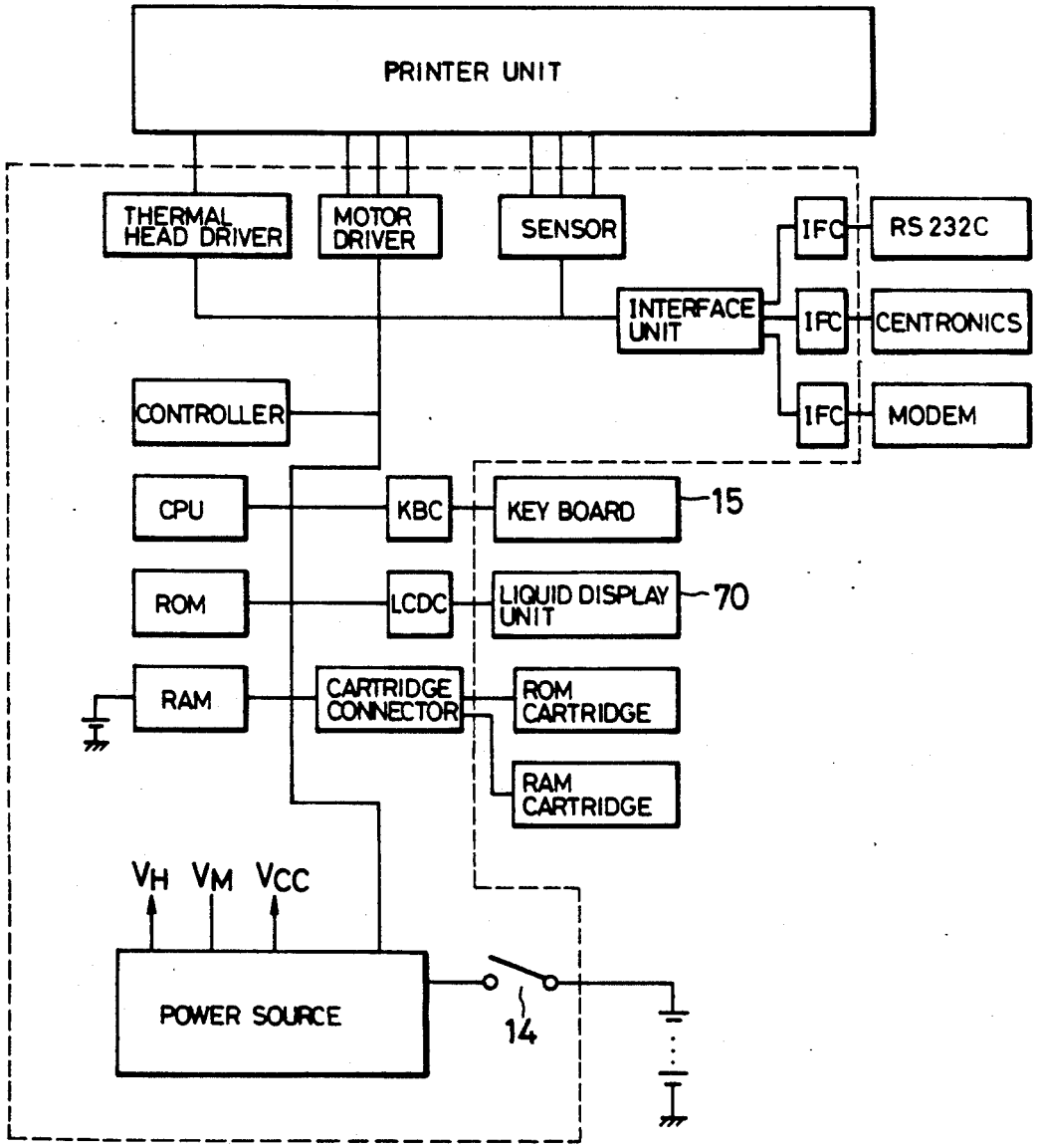
FIG. 18 is a block diagram of an output unit of the present invention.

FIG. 18 is a block diagram of the output apparatus explained in the foregoing.

It is to be noted that FIG. 18 shows the connections of the constituent blocks but detailed control lines are omitted.

A central processing unit (CPU), indicated by a broken line, reads various programs and data from ROM etc. to be explained later, executes necessary calculations and performs various controls. There may be provided plural CPU's if desired. A read-only memory ROM stores various programs for the CPU and data necessary for printing, such as character codes, dot patterns (character generator: CG). A read-write memory TRAM has a working area for temporarily storing the data processed by the CPU, a buffer area for storing data entered from the keyboard 15 and an external interface IFu to be explained later, a text area for storing documents etc., and can store the data when powered by a backup battery even when the power supply is cut off by the power switch 14.

The CPU is connected with a printer unit Pu through a thermal head driver THD, a motor driver MD and a sensor unit Su.

The thermal head driver THD drives the thermal head 25 in the aforementioned printer unit Pu under the control of CPU, while the motor driver MD drives the sheet feed motor Ml, carrier motor M2 and up-down motor M3 also under the control of CPU.

The sensor unit Su transmits the information of the aforementioned limit sensor 23 and sensor 29, provided in the printer unit Pu, to the CPU.

A power source unit PSu supplies a voltage VH for driving the thermal head 25, a voltage VM for the sheet feed motor Ml, carrier motor M2 and updown motor M3, and a voltage Vcc for the logic circuits.

A controller GA executes various controls such as changing the voltage and current of the power VH supplied to the thermal head 25, or changing the heating period or the duty ratio of the thermal head 25, under the control of CPU.

A keyboard 15, for entering various data necessary for printing and editing, is connected to the CPU through the keyboard connector KBC.

Also a liquid crystal display unit 70, for displaying input data from the keyboard 15 or other information, is connected to the CPU through an LCD connector LCDC.

The liquid crystal display unit 70 may be replaced by other display units such as a cathode ray tube.

The CPU can be connected, through an interface connector IFC, to various interfaces for communication with external equipment or for control of the present apparatus by external equipment, such as RS232C interface, centrointerface, modem etc.

Also the CPU can be connected, through a cartridge connector CAC, to a ROM cartridge for special functions and for printing with different typefonts, and to RAM cartridges for memory expansion for storing documents and data.

Though not illustrated, there may be provided an acoustic output device such as a buzzer.

Power-on sequence

Figure 19:
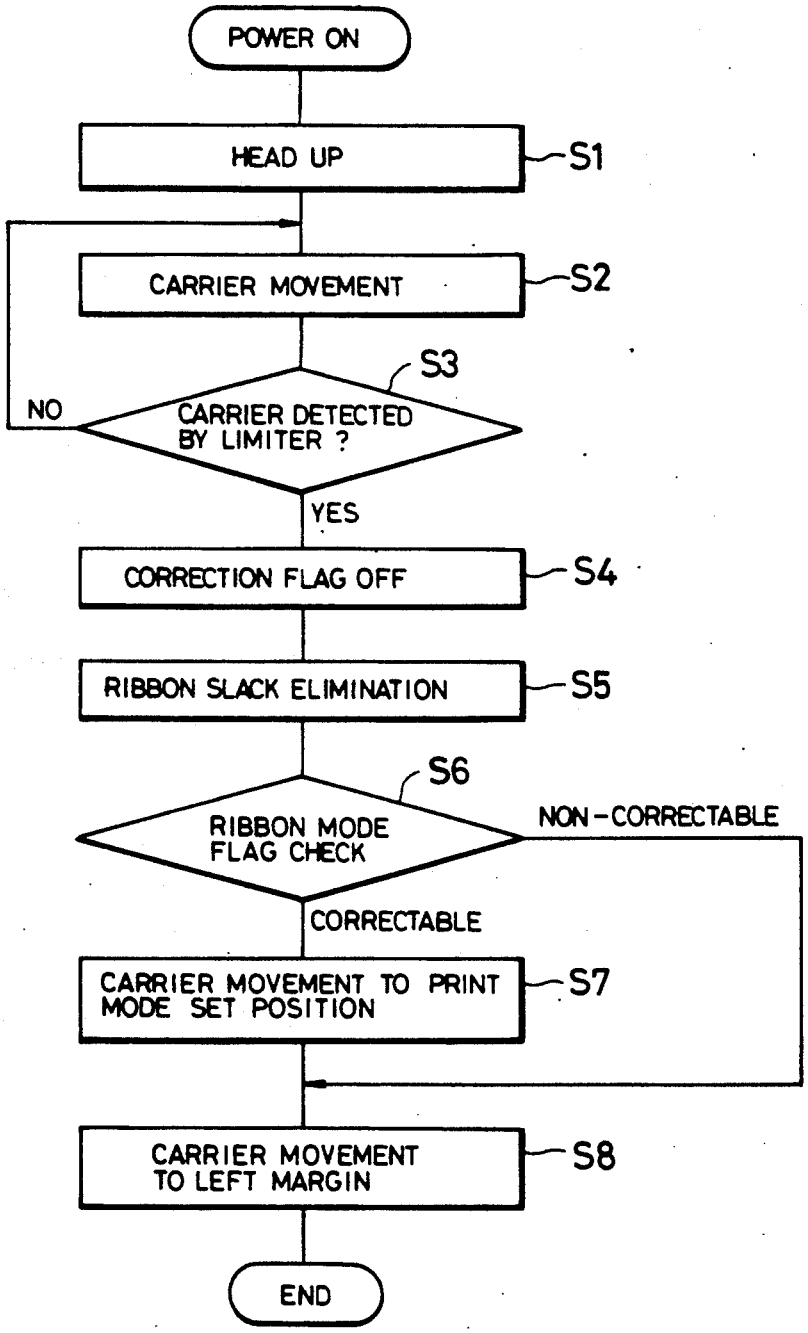
FIG. 19 is a flow chart showing a power-on sequence of the output unit of the present invention.

In the following there will be explained the control of the output apparatus by a program stored in the abovementioned ROM. FIG. 19 is a flow chart showing the power-on control sequence of the output apparatus of the present embodiment. As explained before, the apparatus is equipped with a thermal printer capable of image recording and image correction. The apparatus can accept a correctable ribbon for recording and correction or a non-correctable ribbon (ordinary ink ribbon), and is capable of selecting image recording or correction in case of the correctable ribbon.

In the present embodiment, the printing and correcting information can be the ribbon identification signal or the key-entered signals.

At first, when the power supply is turned on, the thermal head 25 is lifted up to a state separated from the platen 10 (S1), and the carrier 22 is moved toward the limit sensor 23 in order to detect the absolute position of the carrier (S2).

Upon detection of the carrier 22 by the limit sensor 23 (S3), a correction flag stored in the memory TRAM is reset in order to select the printing operation in case of the correctable ribbon (S4). Thus the printing state is the standard mode after power supply is turned on. The standard mode may be displayed. Then the slack in the ribbon is taken up, in order to obtain uniform print quality (S5), as will be explained in detail later. Then in step (S6) the apparatus checks a ribbon mode flag, stored in memory TRAM, and indicating whether the loaded ribbon or the ribbon to be loaded is a correctable one or a non-correctable one. The ribbon mode flag may be set by the sensor 29 identifying the type of ribbon or ribbon cassette, or by a key input or an acostic input of the operator. If the flag indicates the non-correctable mode, the program proceeds to a step S8. On the other hand, if the flag indicates the correctable mode, the carrier 22 is moved to the print set position (FIGS. 14, 15) and the ink ribbon cassette 50 is set to the printing mode, in order to enable a printing operation (S7). In a succeeding step S8, the carrier 22 is moved to a left margin position LM1 for the non-correctable mode in case of the non-correctable mode, or to a left margin position LM2 for the correctable mode in case of the correctable mode. The left margins will be explained later in relation to FIG. 20. The ribbon mode flag is retained even when the power supply is cut off, by a back-up power supply. It is also possible to identify the ribbon when the power supply is turned on, and, if the result is different from that when the power supply is turned off, the apparatus sounds an alarm or displays message prior to the data input because there is a possibility of an error caused by the operator entering data for a correctable ribbon though a non-correctable ribbon is in fact loaded into the apparatus.

Figure 20:
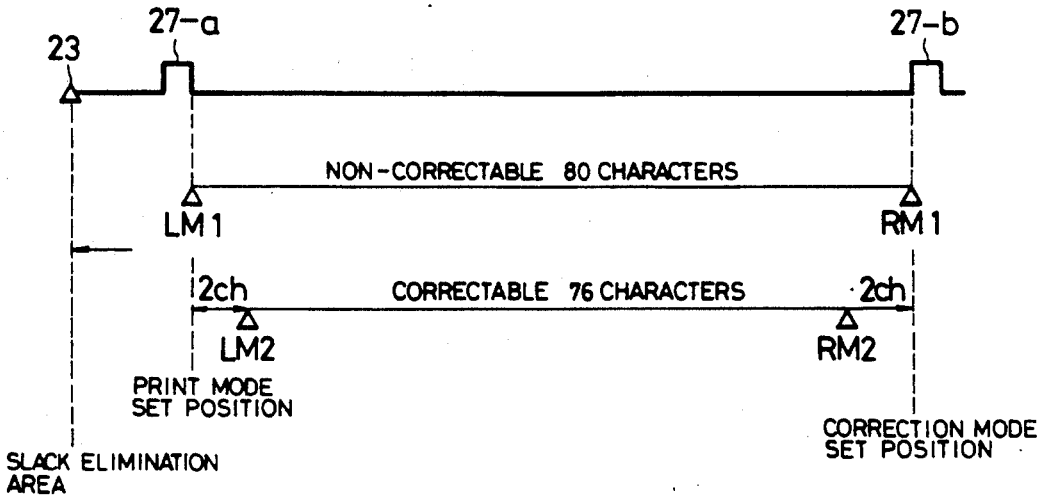
FIG. 20 is a diagram showing image output ranges according to various types of the ribbon.

In the following there will be explained the above-mentioned margins for a non-correctable ribbon and for a correctable ribbon, while making reference to FIG. 20. A left margin position LM1 and a right margin position RM1 define a printable range with the non-correctable ribbon. In the present embodiment 80 characters can be printed. Also for the correctable ribbon LM2 and RM2 define a range in which the printing or correction is possible. In the present embodiment 76 characters can be printed or corrected. Two characters at left end are a correcting mode set position (switching area at the position of projection 27*a*), and two characters at right end are a printing mode set position (switching area at the position of projection 27*b*). Also a range from the sensor 23 to the printable range serves for taking up ribbon slack. The projections 27*a*, 27*b* serve for switching the printing and correcting operations of the ribbon as explained before.

Key input sequence

Figure 21:
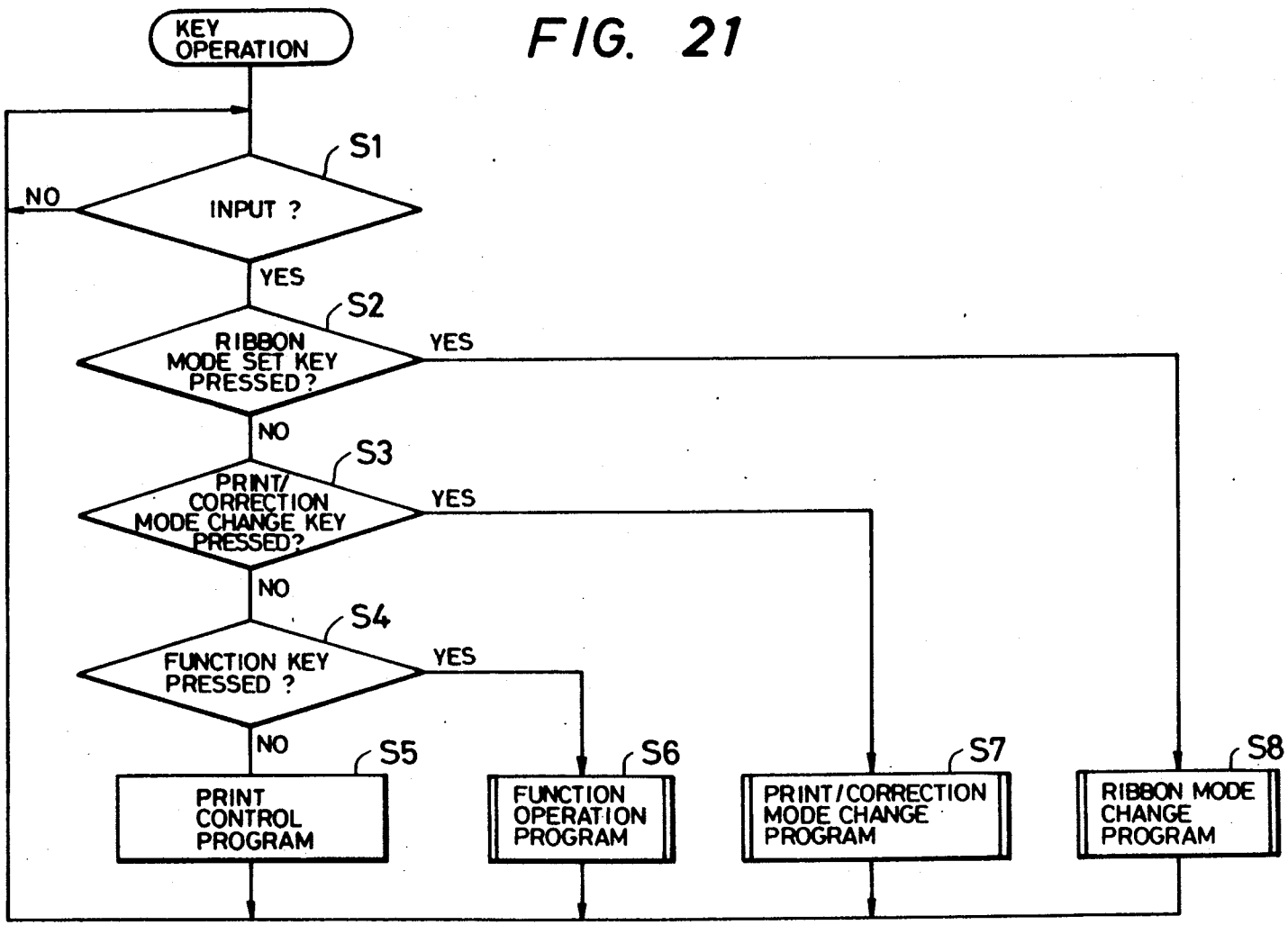
FIG. 21 is a flow chart of a key operation sequence of the present invention.

FIG. 21 is a flow chart showing the sequence for controlling the key inputs by the operator. Upon identifying a key input in a step S1, a step S2 discriminates whether a ribbon mode set key has been actuated, and, if affirmative, the program proceeds to a step S8 for entering a ribbon mode change subroutine, but, if negative, the program proceeds to a step S3. The ribbon mode set key RMKY can be replaced for example by actuations of the mode key MOKY and the numeral key "1" shown in FIG. 4. Then the step S3 discriminates the actuation of a print/correction mode change key CCKY, and, if actuated, the program proceeds to a step S7 for entering a print/correction mode change subroutine. The print/correction mode change key CCKY may be replaced for example by actuation of the mode key MOKY shown in FIG. 4, and the numeral key "2". The print/correction mode change key CCKY serves to change the print/correction mode of the aforementioned correctable ribbon. If the discrimination in the step S3 turns out negative, the program proceeds to a step S4 to discriminate whether the actuated key is a function key such as a return key, a tabulation key, a centering key, a left margin set key etc. If the result is affirmative, the program proceeds to a step S6 for a function key control subroutine.

On the other hand, if the discrimination in the step S4 turns out negative, the actuated key is identified as a print key PRKY and the program proceeds to a step S5 for a print control subroutine. After the completion of the above-explained sequence, the program returns to the step S1 to await a next key input. The foregoing explanation has been limited to the case of data entry through keyboard, through the commands may naturally be given in next information or from an external control equipment such as a host computer.

Ribbon slack takeup

Figure 22:
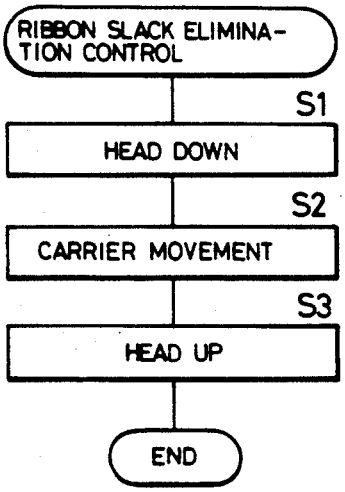
FIG. 22 is a flow chart of a sequence for taking up the slack in the ribbon.

In the following there will be explained the ribbon slack takeup sequence at the step S5 in FIG. 19, the details of which are shown in FIG. 22. In a step S1 the thermal head 25, is lowered thereby enabling ribbon winding in the cassette (cf. FIGS. 5 to 8). Then in a step S2 the carrier 22 is moved by a character pitch in the direction A1 without activating the thermal head 25, and in a step S3 the thermal head is elevated. Through these steps the slack in the ribbon is removed, and the ribbon is maintained at a predetermined tension.

Ribbon mode change

Figure 23:
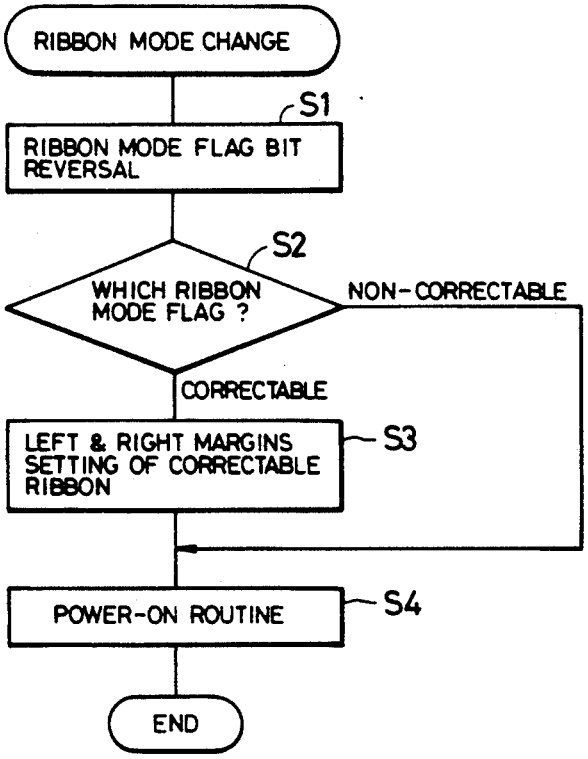
FIG. 23 is a flow chart of a sequence for a ribbon mode change.

Now there will be explained the ribbon mode change subroutine of the step S8 in FIG. 21, the details of which are shown in FIG. 23. At first in a step S1 the ribbon mode flag bit in the memory TRAM is inverted, thus converting the non-correctable mode to the correctable mode, or vice versa. Then in a step S2 the thus converted mode is discriminated, and, if it is a non-correctable mode, the program proceeds to a step S4 to enter the power-on routine shown in FIG. 21. On the other hand, if it is in a correctable mode, in a step S3 the left and right margin positions LM2, RM2 for a correctable ribbon are set, (as shown in relation to FIG. 20), in the memory TRAM in which the positions LM1, RM1 are normally set. Then the program proceeds to the power-on routine in a step S4, in which the ribbon slack is removed and the carrier is moved to the suitable left margin position LM1 or LM2 according to the type of ribbon, as explained before. It is also possible to move the carrier to a margin position determined by the operator. Also the ribbon mode need not necessarily be set by the key input but can be determined by the routine shown in FIG. 25 according to an automatic discrimination by the sensor 29 shown in FIG. 5. Also the presence of above-explained two printing ranges may lead to an erroneous input of the margin position by the operator, but, in such case, an alarm may be sounded or the margin position can be moved to a correct one, disregarding the erroneous input by the operator.

Print/correction mode change

Figure 24:
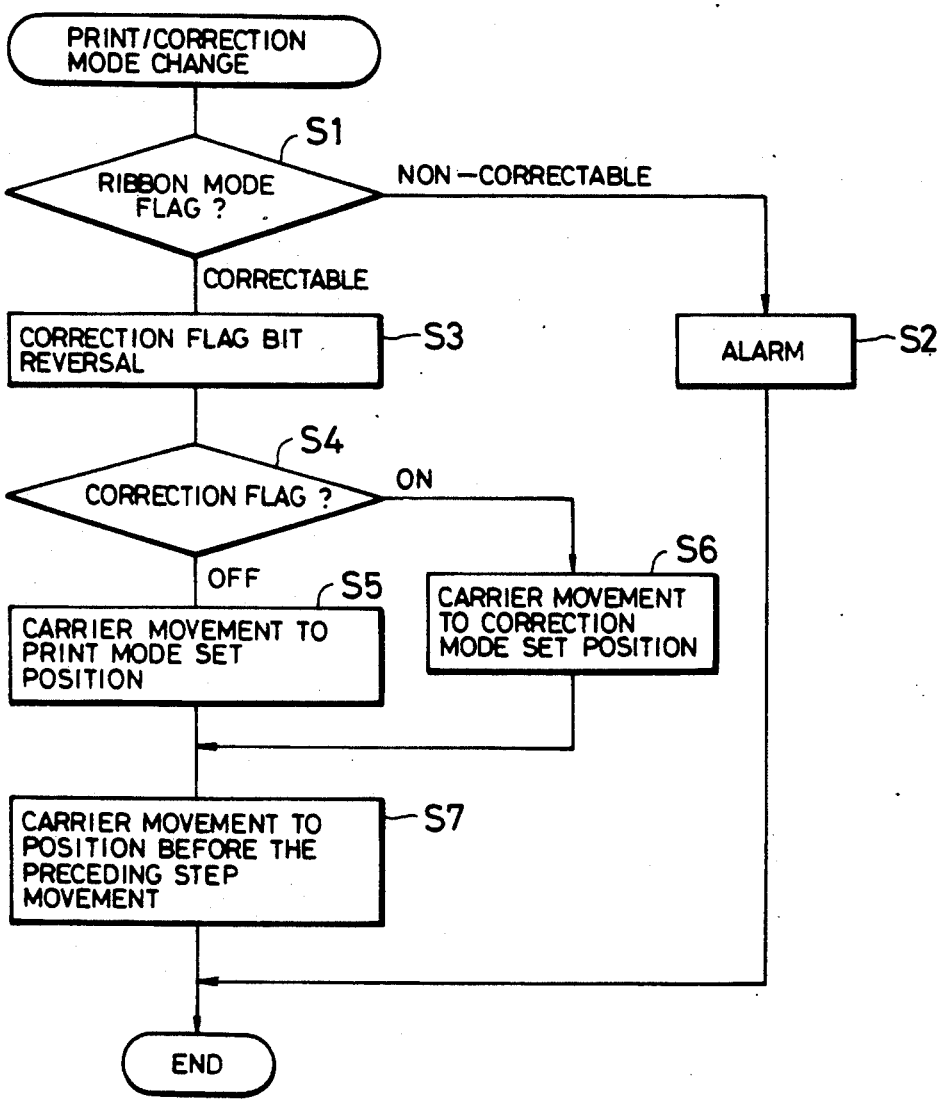
FIG. 24 is a flow chart of a sequence for interchanging the print and correction modes.

In the following there will be explained the print/correction mode change subroutine of the step S7 in FIG. 21, the details of which are shown in FIG. 24. A correctable ribbon cassette has to be loaded in order to change the print/correction modes. Therefore in a step S1 the ribbon mode flag is discriminated and, if a non-correctable ribbon cassette is identified, in step S2 a buzzer or acoustic alarm is sounded or a display is actuated since the entered command for the mode change is invalid. On the other hand, in case the step S1 identifies a correctable ribbon cassette, a step S3 inverts the correction flag in the memory TRAM, thus changing the print mode to the correction mode or vice versa. Also the present carrier position is stored in the memory TRAM. Then in step S4 the thus inverted correction flag is discriminated, and, if it is in the reset state indicating the print mode, the program proceeds to a step S5 to move the carrier to the aforementioned print mode set position. On the other hand, in case the correction flag for indicating the correction mode is set in step S3, the program proceeds to a step S6 to move the carrier to the correction mode set position (see FIGS. 14 and 15). Then in step S7 the carrier is moved to a carrier position prior to the carrier movement in the step S5 or S6, or to a next print position. In the present print/correction mode change subroutine, the ribbon slack removal is not conducted, but it is also possible to conduct such removal in response to the entry of a print/correction mode change signal, for example after the step S7 in FIG. 24.

Print/correction sequence

Figure 25:
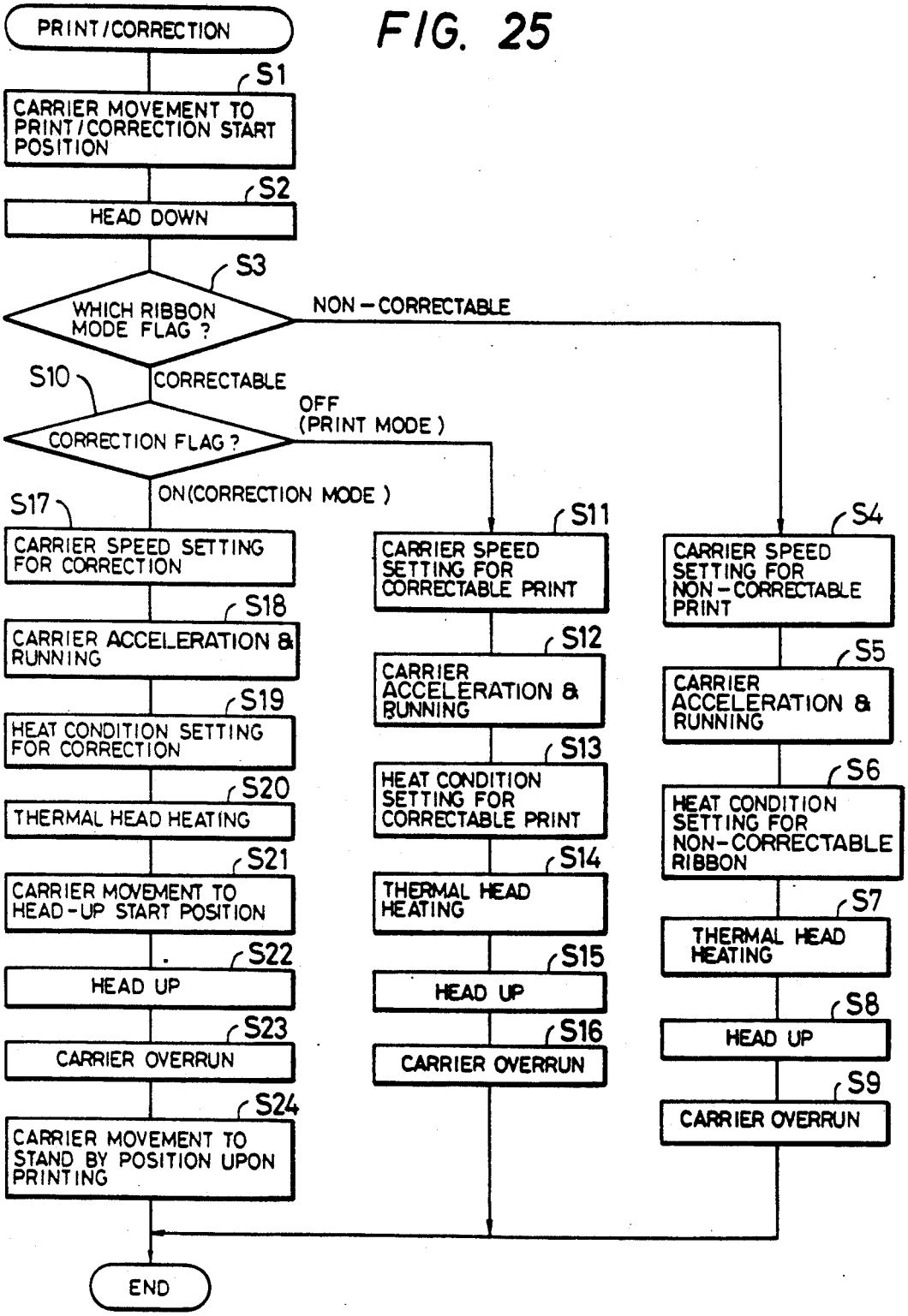
FIG. 25 is a flow chart of a print/correction sequence.

Now there will be explained the print sequence in the step S5 in FIG. 21, the details of which are shown in FIG. 25. In the present embodiment, the output information may be based on any data, such as characters, patterns, images, symbols or combinations thereof. The program proceeds to step S5 by a print command released by the print command key PRKY, but the print command may be generated for every character, or every word, or every line. The movement of the carrier is for example achieved by a motor driver MD shown in FIG. 18, but the motor etc. are excluded from the explanation for the purpose of simplicity.

Referring to FIG. 25, in step S1 the carrier is moved to the print start position, and in step S2 the thermal head 25 is lowered. In step S3 the ribbon mode flag is discriminated and, in case of the non-correctable ribbon mode, the program proceeds to a step S4 for setting the carrier speed for the non-correctable mode by a speed table in the ROM. Subsequently, in step S5 the carrier is accelerated to the thus set speed, for example 18 characters/sec. In step S6 the heating condition is set for the non-correctable mode, by sending commands to the controller GA for regulating the voltage and current, and also the heating time is set for the non-correctable mode, for example heating for 1.1 seconds. In step S7 the thermal head is activated according to the heating condition to effect printing. Then in step S8 the thermal head 25 is elevated, and in step S9 an over-run, or a predetermined movement, of the carrier is effected. The over-run allows the operator to observe the printed character, and also allows the index mark 30*a* to indicate the next printing position. The sequence is terminated in this manner, and the position of the carrier in this state is the print stand-by position in the non-correctable ribbon mode.

On the other hand, if the step S3 identifies the correctable ribbon mode, the program jumps to a step S10 for checking the correction flag. If the flag is reset, indicating the print mode, the program proceeds to a step S11 for setting the carrier speed for the correctable ribbon mode, from a speed table in the ROM. In step S12 the carrier is accelerated to an is then driven at the thus set speed, for example 18 characters/sec. Then in step S13 the heating condition is set for the correctable ribbon mode by the voltage, current and heating time. A step S14 activates the thermal head to such condition to effect printing, and in step S15 the thermal head. In step S16 an over-run is executed to terminate the sequence.

On the other hand, if the step S10 identifies that the correction flag is set, indicating the correction mode, the program proceeds to a step S17 for setting the carrier speed for the correction mode. Then in step S18 the carrier is accelerated to and is then driven at the thus set speed, for example 10 characters/sec. In step S19 the heating condition is then set for the correction mode, and in step S20 the thermal head is activated to effect the correcting operation, for example by heating for 0.4 msec. The carrier speed and the heating condition in the correction mode are selected different from those in other modes, in order to ensure the correcting operation. In step S21 the carrier is lowered to the head-up start position and moves it by a distance l (see FIG. 26) in order to change the peeling position of the ribbon. This change allows the ribbon to cool down, thus realizing the correcting operation. Then in step S22 the thermal head is lifted and in step S23 an over-run is effected in the same manner as in the non-correctable or correctable ribbon mode. In the non-correctable or correctable ribbon mode, the index mark 30*a* indicates the next print position after the over-run in the step S9 or S16, but, in case of the step S24, the index mark does not indicate the next print position because the carrier stops at a position different from that in the non-correctable ribbon mode, because of the step S21. Therefore, the carrier is returned by a distance corresponding to 64 pulses in the step S21, in order to stop the carrier at the same position in the non-correctable ribbon mode. In this manner, the index mark 30*a* is moved to indicate the next print position, in any ribbon mode, or in either print or correction mode.

Figure 26:
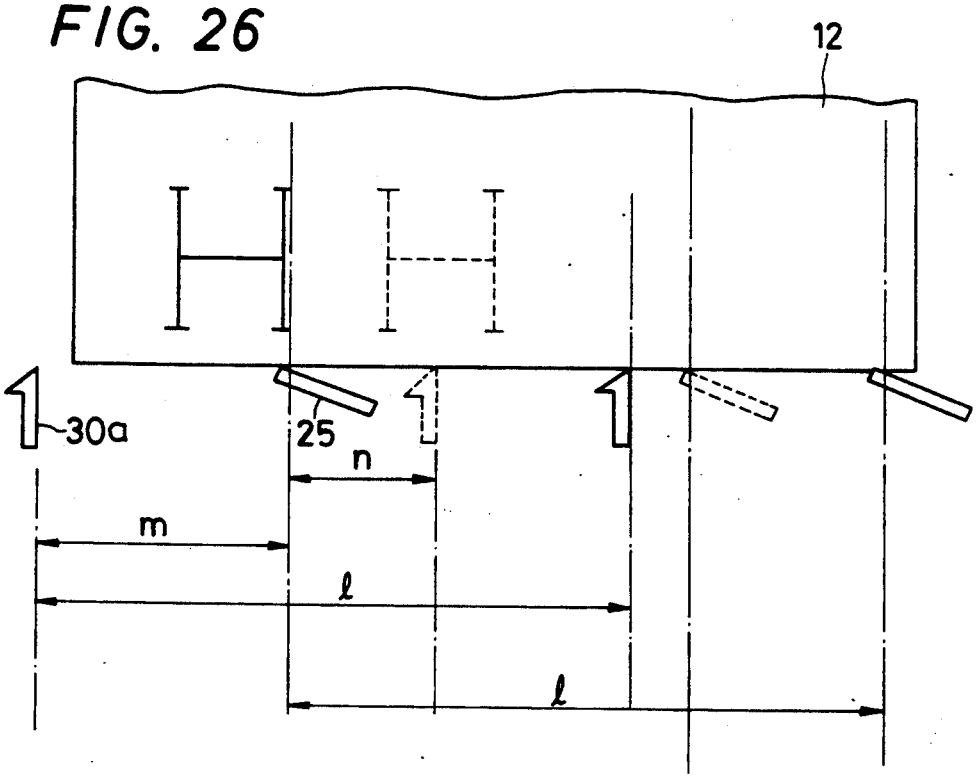
FIG. 26 is a diagram showing the relation of printing position, head and indexes.

FIG. 26 shows the relationship between index mark 30*a*, thermal head 25 and the printed character, wherein solid-lined "H" indicates an already printed character, while a broken-lined "H" indicates a next print position. The distance m between the index mark 30*a* and the thermal head 25 is naturally constant, regardless of the ribbon mode, or print or correction mode (see FIG. 3). The broken-lined index mark indicates a desired position corresponding to the next print position, while a thick-lined index mark indicates the head-up position after the correction. The distance from the position of the thermal head 25 at the end of printing to the center of the next printed character is denoted by m. Thus, in the print mode with the non-correctable or correctable ribbon, there is conducted an overrun of (m+n) for bringing the index mark to the next print position (step S9 or S16 in FIG. 25). In case of the correction mode, the carrier is already advanced by ( (FIG. 26), as already explained in relation to the step S21 in FIG. 25. The amounts n, m and l may have an arbitrary relationship in magnitude. The steps S21, S23 and S24 in FIG. 25 cause carrier movements in the order of l(S21) +(n+m) (S23)−l(S24), but, as will be understood from FIG. 26, it is also possible to advance the carrier by l after printing (S21) and to return the carrier by l−(m+n). The present embodiment employs a regulation of the heating time, but it is naturally possible also to regulate the aforementioned voltage VH.

Though the foregoing embodiments are limited to the structures employing an ink ribbon, the present invention is not restricted to such embodiments but is applicable also to an ink sheet or a wide tape, for example employed in line printers.

Also the recording medium is not limited to the recording paper described in the foregoing embodiments but can for example be a transparent plastic sheet employed for overhead projectors.

Furthermore the heating means is not limited to the thermal head described in the foregoing embodiments but can be suitably composed by other means, such as an infrared light or a laser beam.

In the foregoing embodiments there is described a so-called serial printer in which a thermal head reciprocates along a recording sheet, but the present invention is also applicable to a so-called full-line printer in which heating means such as a thermal head is provided over the entire recording width.

Furthermore, though the foregoing embodiments employ an ink ribbon cassette which houses an ink ribbon therein and can be detachably mounted on the apparatus, the present invention is not limited to such a case. For example it is naturally possible to directly load an ink sheet wound on a reel or as a roll.

Furthermore the foregoing embodiments are limited to a structure in which an ink ribbon cassette performs a reciprocating motion, but the present invention is also applicable to other types in which the ink ribbon cassette is for example stationary.

Furthermore, in the foregoing embodiments, the peeling control member such as the peeling roller is provided on the cassette, but, in the present invention, such a mechanism can naturally be provided on the apparatus.

Furthermore, in the foregoing embodiments, the cooling of ink sheet after heating thereof is achieved by spontaneous cooling resulting in the delayed peeling, but the present invention can also utilize forced cooling, for example by contacting a metal such as iron or aluminum with the ink sheet or by blowing cold air to the ink sheet.

As explained in detail in the foregoing, these embodiments can record an image on a recording medium according to recording information, and also correct erroneous recording if necessary.

In the following there will be explained still another embodiment shown in FIGS. 27 to 32, in which the aforementioned peeling lever is protruded or retracted by a motor. In the present embodiment, therefore, it is no longer necessary to move the carrier to the right or left end for protruding or retracting lever. Instead, the peeling lever can be protruded or retracted at an arbitrary carrier position, by activating the motor in response to a recording signal or a correction signal.

In the embodiment to be explained in the following, the peeling lever is not provided on the cassette but on the carrier of the apparatus, so that there can be employed an ordinary cassette. In the following description there is employed a so-called correction ribbon designed exclusively for correction, but it is also possible to employ the aforementioned self-correction ribbon.

More specifically the present embodiment provides a thermal transfer recording apparatus comprising a recording head; recording means on which the recording head and vertical drive means therefor are mounted; means for causing a relative movement in the recording means or a recording medium; and means for contacting an ink ribbon with the recording medium in a recording operation to cause the recording head to thermally transfer the ink from the ink ribbon to the recording medium and contacting a correction ribbon with the recording medium in a correction operation to cause the recording head to thermally re-transfer the ink present on the recording medium to said correction ribbon, wherein the time of separating the ink ribbon from the recording medium after the thermal transfer and the time of separating the correction ribbon from the recording medium after the thermal re-transfer are rendered variable by a member linked with the head drive means.

In such thermal transfer recording apparatus, a member linked with a motor for vertically moving the recording head is retracted from the rear side of the ink ribbon in the printing operation but is pushed forward, in the correction operation, to push the correction ribbon against the recording sheet, whereby the peeling time, before the ribbon is separated from the recording sheet in the correction operation, can be selected to be longer or shorter than in the printing operation, thereby avoiding incomplete lift-off of the ink from the recording sheet.

In the following this embodiment will be clarified in greater detail, while making reference to the attached drawings.

Figure 27:
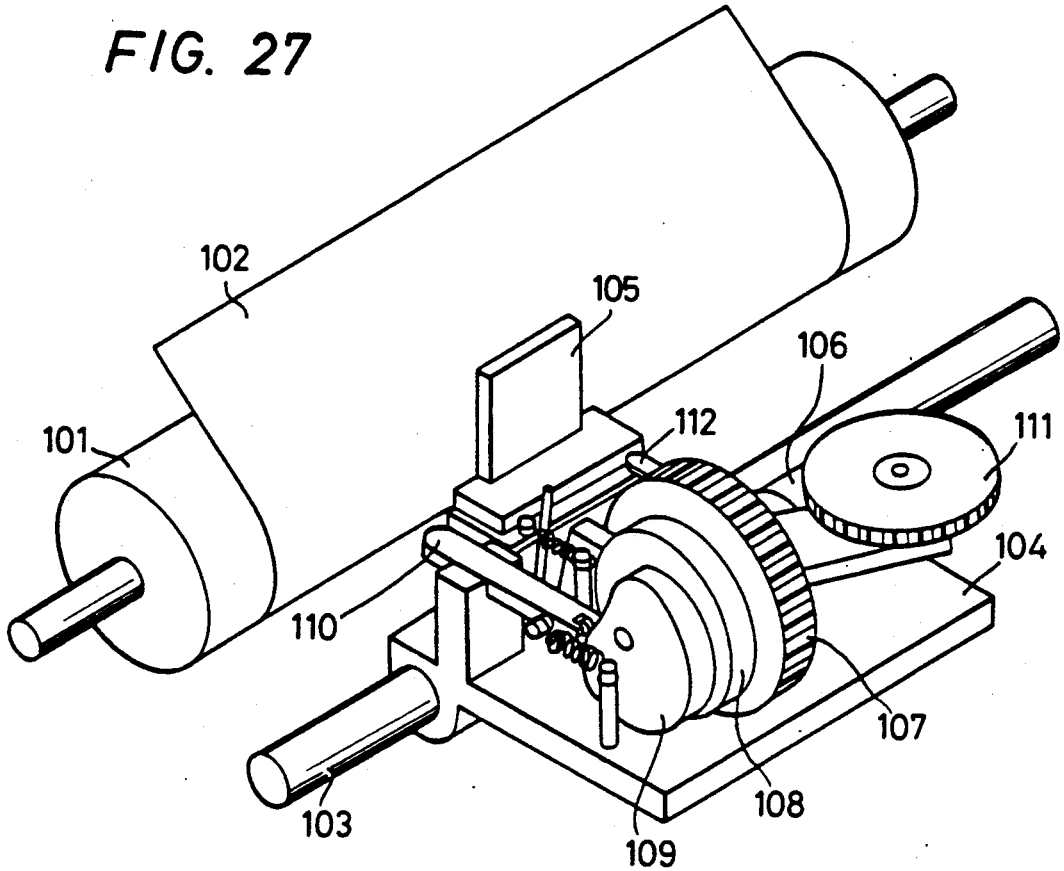
FIG. 27 is a perspective view of a thermal transfer recording apparatus employing another embodiment of the present invention.

FIG. 27 shows a platen 101 supported by an unrepresented base member of the apparatus functions as a sheet advancing roller, and a recording sheet 102 which is wound thereon. With respect to recording sheet 102 supported on the platen 101, a carriage 104 is provided slidably on a guide shaft 103 parallel to platen 101. A recording head 105 provided with unrepresented heating elements is vertically movable, and is maintained at a lower position in the printing or correcting operation, and at an upper position in the stand-by state.

A stepping motor 106, mounted on the carriage 104 rotates a gear 107 and cams 108, 109 fixed on the shaft of gear 107. The cam 108 is an up-down cam for vertically moving the recording head 105, while the cam 109 is used for regulating the ribbon peeling time. Cam 109 moves a correction lever 110 to a protruding position or a retracted position with timings of a cam chart shown in FIG. 28.

A ribbon take-up gear 111 winds up an ink ribbon 114 by meshing with an unrepresented rack gear provided parallel to the guide shaft 103, through a shift lever 112 linked with the movement of recording head 105.

Figure 28:
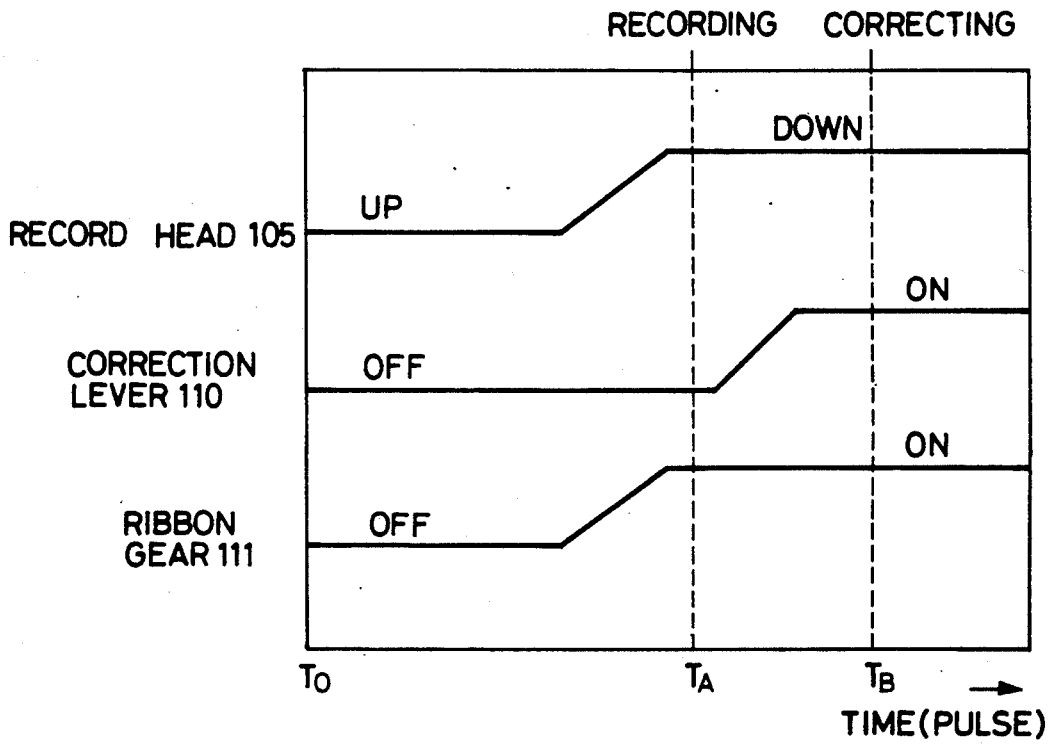
FIG. 28 is a cam chart showing the function timings of the recording head, correction lever and ribbon gear in the embodiment shown in FIG. 27.

The cam chart in FIG. 28 shows the timings of the vertical movement of the recording head 105, protrusion and retraction of the correction lever 110, and the ribbon take-up by the ribbon gear 111, all caused by the rotation of the cams 108, 109.

At a timing $T_0$ when the stepping motor 106 is activated, the recording head 105 is maintained at the upper stand-by position by the cam 108, and the linked ribbon gear 111 does not function. Also the correction lever 110 is maintained at the standby position by the cam 109.

Figure 29:
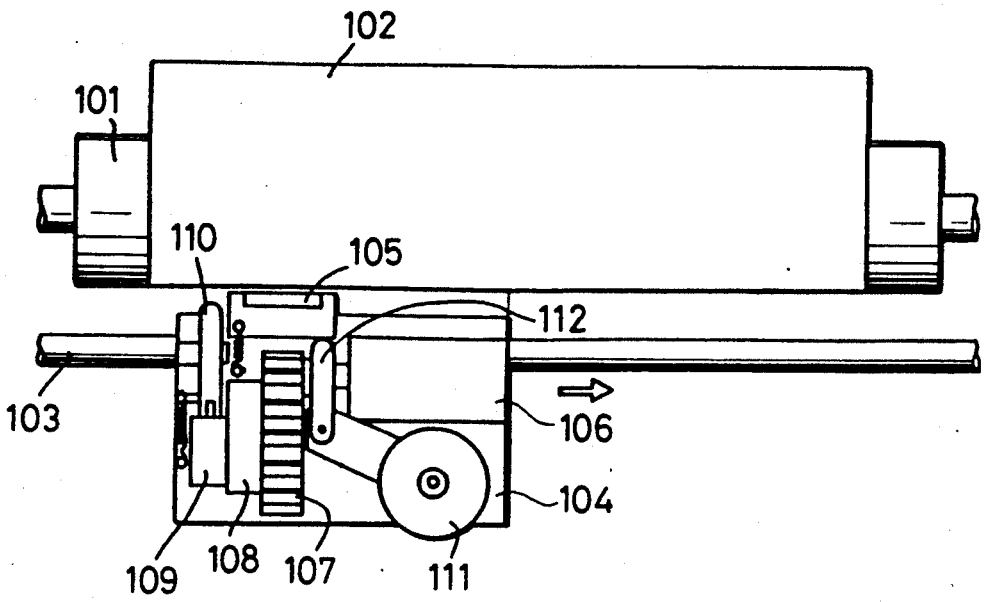
FIGS. 29 and 30 are respectively a plan view and a magnified partial view of the state of the head in the recording operation of the thermal transfer recording apparatus of an embodiment of the present invention.

Then, when the stepping motor 106 is driven according to the recording information whereby the cams 108, 109 are moved to a time $T_A$ and then stopped, the recording head 105 is maintained at the lower recording position by the cam 108, and the ribbon gear 111 simultaneously meshes with the unrepresented rack gear to enable ribbon take-up. The ribbon takeup or winding is achieved by the rotation of the gear 111, caused by sliding motion of the carriage 104 along the guide shaft 103. At time $T_A$, the correction lever is still maintained at the standby position, as shown in FIG. 29.

Figure 30:
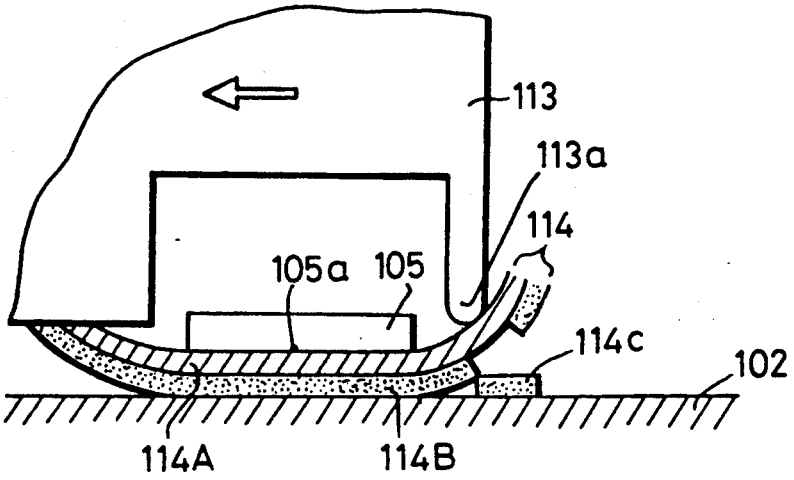

In the above-explained state, the recording operation can be conducted by moving the carriage 104 by an unrepresented motor, along the guide shaft 103 in a direction indicated by an arrow, and activating the recording head 105 to effect thermal ink transfer. FIG. 30 shows the state of thermal ink transfer by the recording head 105 in the recording operation, wherein shown are an ink ribbon cassette 113 housing an ink ribbon, and the ink ribbon 114 which is extracted from the cassette 113 and maintained in contact with the recording sheet 102 by the recording head 105. Ink ribbon 114 is taken up into the cassette 113 by the rotation of the ribbon gear 111. Ink ribbon 114 is composed of a substrate 114A and a thermally transferrable ink layer 114B formed thereon. Ink of the ink layer 114B is selected to be non-permeable with respect to the recording sheet. After recording, the ink ribbon 114 is separated from the recording sheet 102 at a lateral end 113*a* of the ribbon cassette 113 by a tension applied to ribbon 114.

Consequently, by activating the heating elements 105*a* of the recording head 105 according to recording information in a state shown in FIG. 30, the heated portion of the ink layer 114B can be thermally transferred and adhered to the recording sheet 102. 114C indicates the ink, or recorded image, which is thus transferred by the recording head 105 and left after the ink ribbon 114 is separated from the recording sheet 102, as the result of movement of head 105.

In the recording operation, the ink ribbon 114 is peeled off from the recording sheet 102 immediately after the transfer of ink 114C onto recording sheet 102, and a secure thermal transfer recording is rendered possible by lifting the ink ribbon 114 from the sheet 102 at a position as close as possible to the recording head 105.

Figure 31:
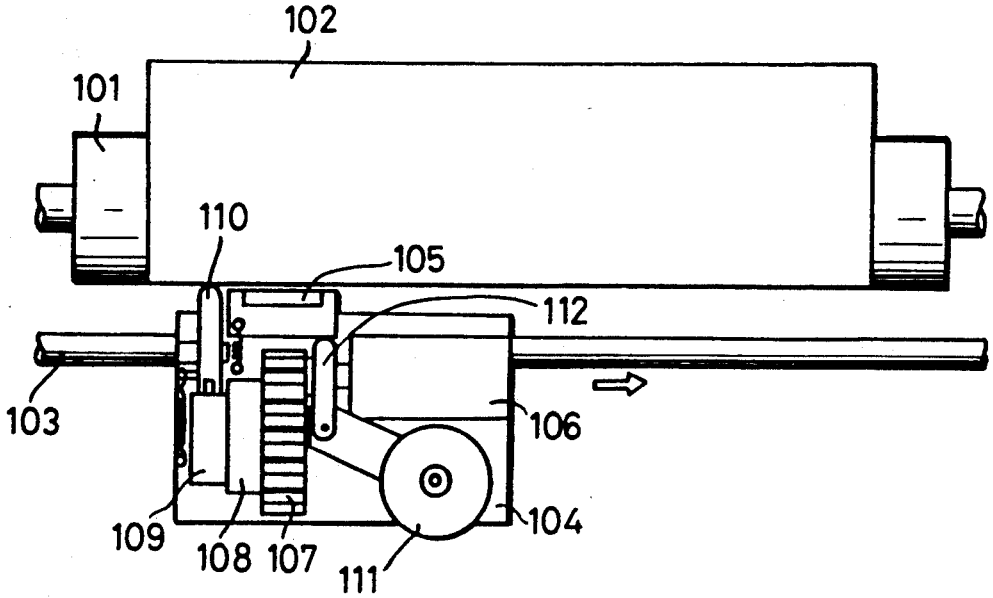
FIGS. 31 and 32 are respectively a plan view and a magnified partial view of the state of the head and correcting lever in the correcting operation of the present invention.

Again referring to FIG. 28, when the cams 108, 109 are rotated by the stepping motor 106 according to correction information and stopped at a time $T_B$, the recording head 105 is maintained at the lower recording position, while the ribbon gear 111 is maintained in the ribbon take-up position, and the correction lever 110 is in the protruding position (see FIG. 31).

Figure 32:
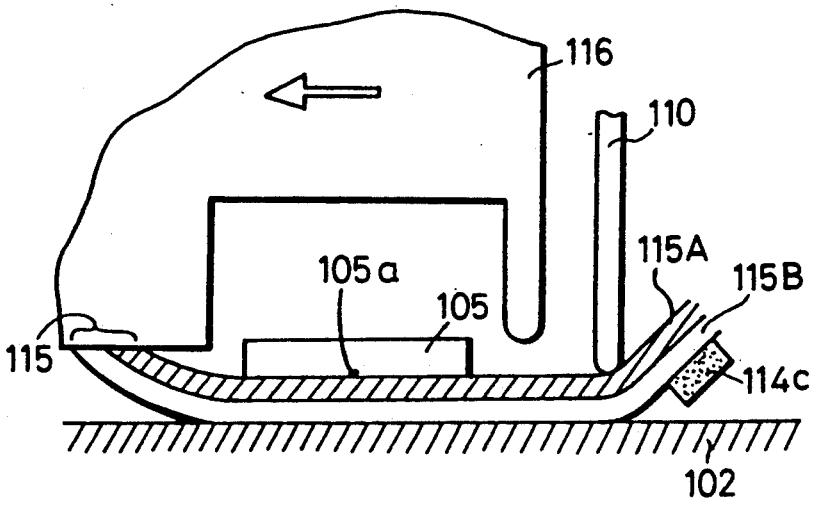

The correction operation in the present embodiment is conducted in such state, and FIG. 32 shows the state of correction operation by the head 105. In this case there is shown the use of a liftoff tape 115 designed exclusively for correction, which is housed in a tape cassette 116 and is composed of a substrate 115A and a thermal adhesive layer 115B. Heat from the recording head 105 causes the adhesion of adhesive layer 115B and the ink 114C deposited on the sheet 102, thereby lifting off the ink 114C from the sheet.

In such correction operation, complete ink lift-off may not be achieved if the lift-off tape 115 is separated from the recording sheet 102 immediately after the heating by the recording head 105, because sufficient adhesion cannot be obtained due to insufficient cooling. However, by the correction operation of the present embodiment in which the correction lever 110 is in the protruding position, a secure correction can be achieved because of an extended period from the retransfer of ink 114C to the adhesive layer 115B heated at the recording head 105 to the separation of the lift-off tape 115 from the sheet 102.

In the foregoing embodiment there is explained a structure in which the carriage is moved parallel to the recording medium, but the present invention is also applicable to a thermal transfer recording apparatus in which the recording medium is moved parallel to and with respect to the recording means. Also the present invention is not limited to the lift-off tape exclusive of correction but U also applicable to so-called self-correction ribbon usable both for recording and correction.

In the foregoing embodiments the time to the separation of the correction ribbon from the recording medium is elongated, but the present invention is applicable also in case of reducing this time. Also the control of the foregoing embodiments is applicable to this case by suitable modification.

As will be apparent from the foregoing explanation, the present embodiment is capable of securing recording and correction with a simple structure, since a motor for vertically moving the recording head is also used for winding the ribbon and for varying the peeling time thereof from the recording sheet. Also the means for varying the peeling time can be activated at any position of the carrier, since this means can be operated by a motor.

Now there will be explained still another embodiment, while making reference to FIGS. 33 to 36.

In this embodiment, means for controlling the timing of peeling the ink ribbon from the recording medium is provided on a ribbon cassette, and clean correction can be achieved by varying the peeling time of the correction ribbon by means of the form of the ribbon cassette.

Now reference is made to FIGS. 33 to 36 for explaining the present embodiment, wherein the same components as those in the foregoing embodiments are represented by same numbers.

Figure 33:
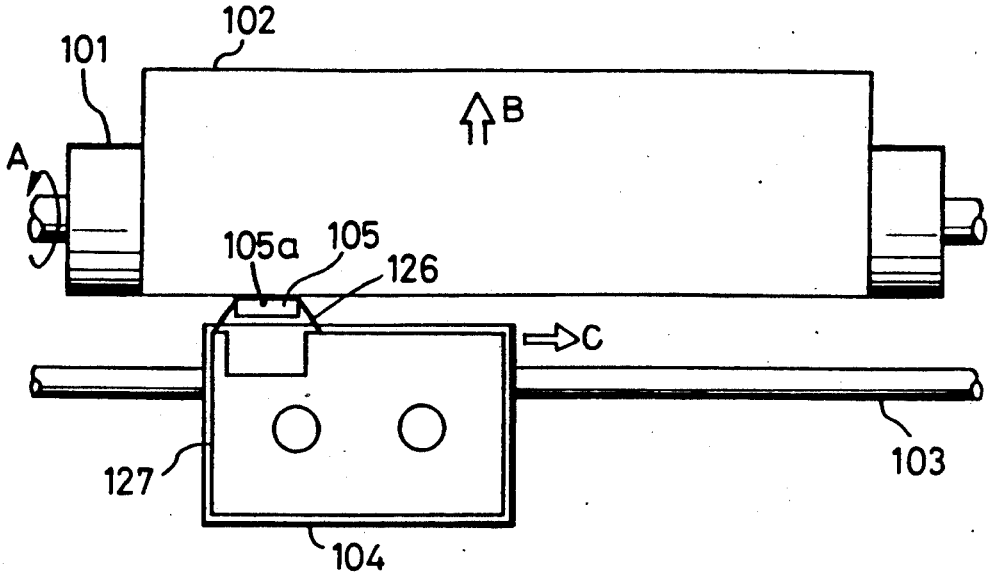
FIGS. 33 and 34 are plan views showing the state of the ribbon cassette at the recording operation and the correcting operation in a thermal transfer recording apparatus employing another embodiment of the present invention.

In FIG. 33, there is shown an ink ribbon cassette 127 housing an ink ribbon 126 and capable of feeding and taking up said ribbon 126 in synchronization with the movement of the carriage 104.

Figure 34:
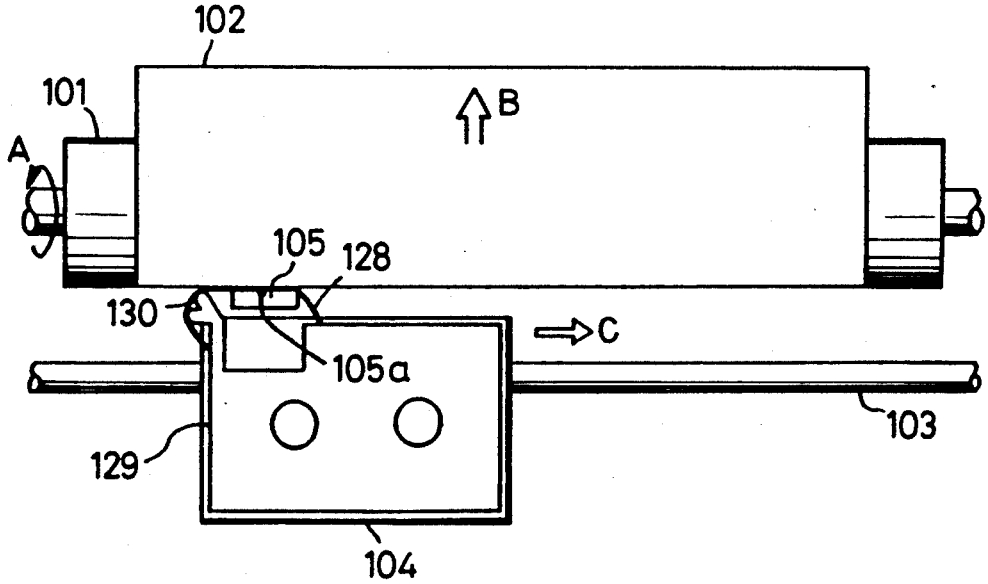

In FIG. 34, there is shown a tape cassette 129 housing a lift-off correction tape 128 and capable of performing a function the same as that of the ink ribbon cassette 127. Tape cassette 129 is equipped with a projection 130, at an end thereof facing the recording sheet 102, capable of maintaining the lift-off tape 128 pressed to the recording sheet 102. Cassettes 127, 129 can both be detachably mounted on the same carriage 104.

In such thermal transfer recording apparatus, the recording sheet 102 can be advanced in a direction B by the rotation of the platen 101 in a direction A. In the recording operation, thermal transfer recording is achieved by moving the carriage 104 in a direction C while the recording head 105 is maintained as shown in FIG. 33. Also correction by thermal re-transfer of the ink to the lift-off tape 128 can be achieved by loading the carriage 104 with the tape cassette 129 for the lift-off tape 128 and effecting a similar operation.

Figure 35:
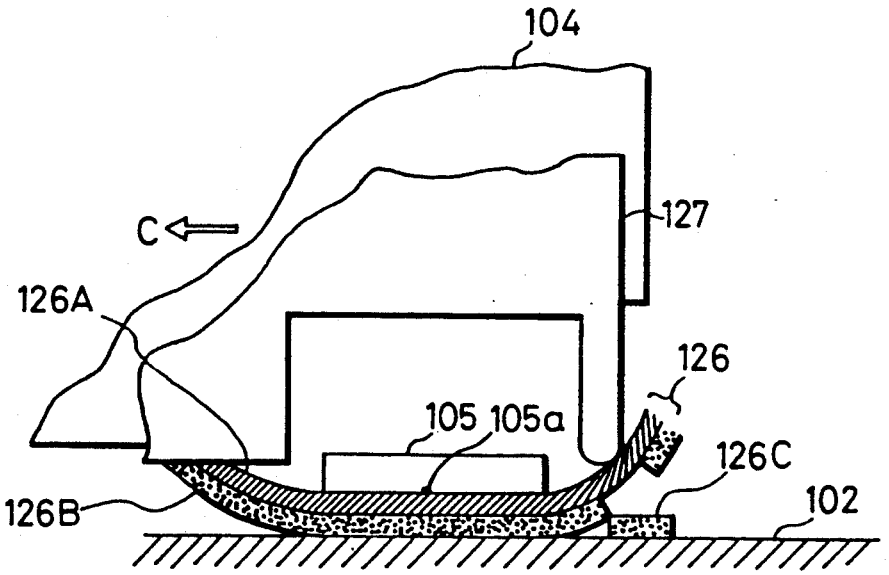
FIGS. 35 and 36 are partial detailed views showing the state of the ribbon in the vicinity of the recording head respectively in the recording operation and in the correcting operation of the present invention.

FIG. 35 shows the thermal transfer operation by the recording head 105 in the recording mode, wherein the ink ribbon 126 is pressed to the recording sheet 102 by the recording head 105 but is peeled from the recording sheet 102 along with the movement of the carriage 104 supporting the ribbon cassette 127.

The ink ribbon 126 is composed of a substrate 126A and a thermally transferrable ink layer 126B which is formed on the substrate and is non-permeable with respect to the recording sheet 102. Thus, as an end of the ink ribbon 126 is pulled up, a portion of the ink layer heated by the recording head 105 remains as an ink dot 126C on the recording sheet 102.

Secure thermal transfer recording can be achieved by peeling the ink ribbon 126 from the recording sheet 102 as immediately as possible after the heating with the recording head 105, namely by lifting the ink ribbon 126 at a position as close as possible to the recording head 105.

Figure 36:
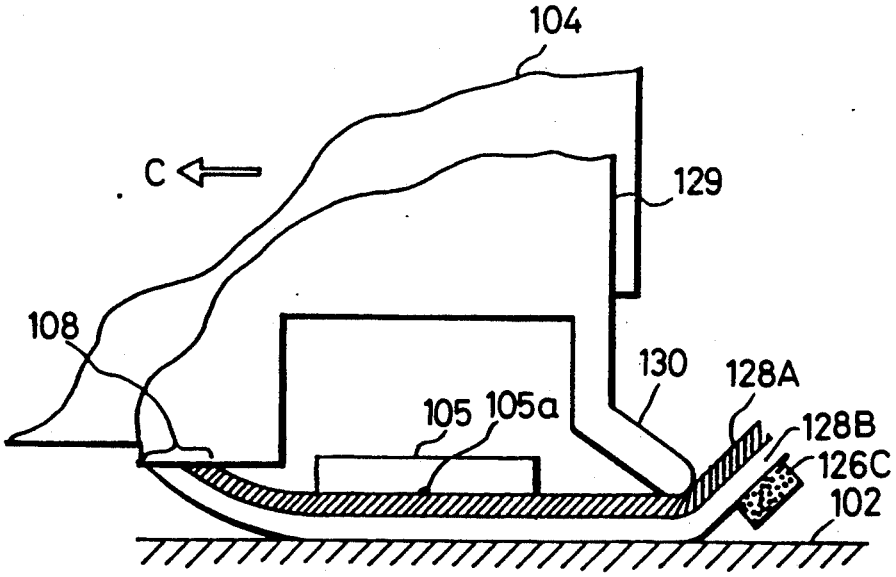

FIG. 36 shows the correcting operation by the recording head 105. As in the recording mode, the lift-off tape 128 is peeled from an end along with the movement of the carriage 104 supporting the lift-off tape cassette 129, but the lift-off tape 128 is maintained in contact with the recording sheet 102 for a longer period than in the case of FIG. 35, because of the presence of a projection 130 on the tape cassette 129, in a rear position in the moving direction of the carriage 104.

The lift-off tape 128 is composed of a substrate **128*a* and a heat-sensitive adhesive layer 128B formed thereon, whereby the heat from the recording head 105 causes the ink dot 126C on the recording sheet 102 to adhere to the adhesive layer 128B and to be lifted off from sheet 102. However, if the lift-off tape 128 is peeled off from the recording sheet 102 immediately after heating by the recording head 105, complete lift-off of the ink dot 126C may not be achieved because sufficient adhesive force cannot be obtained due to insufficient cooling. In the present embodiment, however, secure correction can be achieved since the time to peeling of the lift-off tape 128 can be extended by the presence of the projection 130**.

The foregoing explanation is limited to a structure in which the carriage is moved parallel to the recording medium, but the present invention is applicable also to a thermal transfer recording apparatus in which the recording medium is moved parallel to and with respect to the recording means.

Also the foregoing explanation is limited to the case of extending the time to the peeling of the correction ribbon from the recording medium, but the present invention is applicable also to a case of reducing the peeling time, by suitably modifying the projection of the above-explained lift-off tape cassette.

As explained in the foregoing, the present embodiment allows one to obtain clean correction by the presence of a member, at a ribbon take-up end of a cassette housing a correction ribbon, for maintaining the correction ribbon in contact with the recording medium, thereby ensuring thermal re-transfer by the correction ribbon.

The present invention may also employ suitable heating means other than thermal head, such as selective heating means employing a YAG laser and a polygon mirror. Also the recorded image can be characters, numerals, patterns or combinations thereof. Furthermore the ink sheet need not necessarily be formed as an ink ribbon but can be formed as a wide sheet often employed in line printers. Furthermore, in the foregoing embodiments, the correction of the recorded image is achieved by lift-off thereof, but the present invention is also applicable to a cover-up tape which covers the recorded image.

As explained in detail in the foregoing, the present invention provides an image recording apparatus capable of correcting recorded image, and an ink sheet cassette adapted for use in the image recording apparatus.

What is claimed is:

1. An image recording apparatus for recording an image on a record medium, said apparatus comprising:

a mounting section for detachably mounting an ink sheet containing ink thereon comprising a main body and a movable element movable with respect to said main body;

ink sheet conveying means for conveying the ink sheet mounted on said mounting section;

recording means for affecting the ink sheet mounted on said mounting section to record an image on the record medium, said recording means shiftable between an affecting position for affecting the ink sheet and a retracting position retracted from said affecting position, said recording means comprising a portion contacting said movable element for moving said movable element during shifting between the affecting position and the retracting position.

driving means for shifting said recording means between said affecting position and said reacting position;

displacing means provided downstream of said recording means with respect to a conveying direction of the ink sheet and shiftable so as to select a conveyance route of the ink sheet for recording or a conveyance route of the ink sheet for correcting an image on the record medium in response to receiving recording information or correction information, wherein said displacing means comprises:

means for engaging the ink sheet when a conveyance route of the ink sheet for correcting an image is selected and for disengaging the ink sheet when a conveyance route of the ink sheet for recording is selected; and means for engaging and disengaging said movable element, wherein when said movable element engaging and disengaging means engages said movable element, said movable element and ink sheet engaging and disengaging means are shifted, in response to movement of said movable element during shifting of said recording means, so that said ink sheet engaging and disengaging means moves from engagement to disengagement from the ink sheet or from disengagement to engagement with the ink sheet; and a motor for imparting a driving force to said driving means.

2. A recording apparatus according to claim 1, wherein said driving means also displaces the ink sheet.

3. A recording apparatus according to claim 1 further comprising the ink sheet, wherein said ink sheet is capable of recording an image of the record medium and also is capable of correcting a recorded image when required.

4. A recording apparatus according to claim 1, further comprising the ink sheet, wherein said ink sheet is provided with ink to be transferred onto the record medium for forming an image thereon, and a lift-off layer for lifting off the ink adhered to the record medium.

5. A recording apparatus according to claim 1, further comprising the ink sheet, wherein said ink sheet is a self-correction ribbon usable for both image recording and correction of a recorded image.

6. A recording apparatus according to claim 1, wherein said mounting section is further adapted to detachably mount an ink sheet used exclusively for correcting a recorded image.

7. A recording apparatus according to claim 1, further comprising heating means for heating the ink sheet, wherein the amount of heating by said heating means is varied between image recording and image correction.

8. A recording apparatus according to claim 1, further comprising heating means for heating the ink sheet, wherein said heating means is adapted to move along the record medium with different speeds during image recording and during image correction.

9. A recording apparatus according to claim 1, wherein said displacing means comprises a peeling lever for varying the timing of peeling of the ink sheet from the record medium after recording thereon.

10. A recording apparatus according to claim 1, further comprising means for removing slack in the ink sheet formed when said displacing means is disengaged from the ink sheet.

11. A recording apparatus according to claim 1, further comprising the ink sheet, wherein said ink sheet records said image on the record medium and peels the image recorded on the record medium from the record medium.

12. A recording apparatus according to claim 1, further comprising the ink sheet, wherein said ink sheet comprises ink to be transferred to the record medium to record the image on the record medium and a peeling layer for peeling the image recorded on the record medium from the record medium.

13. A recording apparatus according to claim 1, further comprising the ink sheet, wherein said ink sheet comprises a self-correction type ink ribbon which is adapted to record the image and erase the recorded image.

14. A recording apparatus according to claim 1, further comprising the ink sheet, wherein said mounting section is further adapted to detachably mount an ink sheet used exclusively for correcting a recorded image.

15. A recording apparatus according to claim 1, wherein said recording means applied heat to the ink sheet from the outer portion thereof to the inner portion thereof.

16. A recording apparatus according to claim 1, wherein said displacing means changes the conveyance path of the ink sheet in such a manner that the ink sheet contacts the record medium.

17. A recording apparatus according to claim 1, wherein said apparatus peels the ink sheet from the record medium after the ink sheet is transferred to the record medium, wherein said displacing means changes the time at which the ink sheet is peeled from the record medium after said recording means effects recording with the ink sheet.

18. A recording apparatus according to claim 17, wherein said displacing means comprises a lever for delaying the time when the ink sheet is peeled from the record medium after said recording means effects recording with the ink sheet.

19. A recording apparatus according to claim 1, wherein said displacing means comprises a lever projecting in the direction of the record medium.

20. A recording apparatus according to claim 18, wherein said lever of said displacing means is adapted to be displaced downwardly, wherein said recording means is displaced to said affecting position sequentially after said lever of said displacing means is displaced downwardly.

21. A recording apparatus according to claim 1, wherein said displacing means comprises a lever projecting in the direction of the record medium.

22. A recording apparatus according to claim 1, wherein said recording means is adapted to be displaced downwardly, sequentially after said movable element is displaced, for affecting the ink sheet.

23. A recording apparatus according to claim 1 further comprising:

an ink sheet cassette housing the ink sheet, mounted on said mounting section, said cassette having:

an ink sheet supply portion for supporting the ink sheet;

an ink sheet supply portion for supporting the ink sheet;

an ink sheet take-up portion for winding the ink sheet supplied from said ink sheet supply portion;

a first driving force receiving portion;

transmitting means for transmitting a driving force to said first driving force receiving portion which receives the driving force which enables the ink sheet take-up portion to wind the ink sheet, wherein said transmitting means has a taking-up lever and a gear for transmitting the driving force to said first driving force receiving portion provided on said ink sheet cassette mounted on said mounting section.

24. A recording apparatus according to claim 1, further comprising:

an ink sheet cassette housing the ink sheet, mounted on said mounting portion, said cassette having:

an ink sheet supply portion for supporting the ink sheet;

an ink sheet take-up portion for winding the ink sheet supplied from said ink sheet supply portion;

a first driving force receiving portion;

transmitting means for transmitting a driving force to said first driving force receiving portion which receives the driving force which enables the ink sheet take-up portion to wind the ink sheet;

wherein said transmitting means has a connecting lever and a switching lever for transmitting the driving force to a second force receiving portion provided on said ink sheet cassette mounted on said mounting section.

25. An image recording apparatus for recording an image on a record medium, said apparatus comprising:

a mounting section for detachably mounting an ink sheet containing ink thereon comprising a main body and a movable element movable with respect to said main body;

ink sheet conveying means for conveying the ink sheet mounted on said mounting section;

recording means for affecting the ink sheet mounted on said mounting section to record an image on the record medium, said recording means being shiftable between an affecting position for affecting the ink sheet and a retracting position retracted from said affecting position, said recording means comprising a portion contacting said movable element for moving said movable element during shifting between the affecting position and the retracting position;

displacing means provided downstream of said recording means with respect to a conveying direction of said ink sheet and shiftable so as to select a conveyance route of the ink sheet for recording or a conveyance route of the ink sheet for correcting an image on the record medium in response to recording information or correction information, wherein said displacing means comprises:

means for engaging the ink sheet when a conveyance route of the ink sheet for correcting an image is selected and for disengaging the ink sheet when a conveyance route of the ink sheet for recording is selected; and means for engaging and disengaging said movable element, wherein when said movable element engaging and disengaging means engages said movable element, said movable element and ink sheet engaging and disengaging means are shifted, in response to movement of said movable element during shifting of said recording means, so that said ink sheet engaging and disengaging means moves from engagement to disengagement from the ink sheet or from disengagement to engagement with the ink sheet; and a motor for imparting a driving force to said ink sheet conveying means.

26. A recording apparatus according to claim 25 further comprising the ink sheet, wherein said ink sheet is capable of recording an image of the record medium and also is capable of correcting a recorded image when required.

27. A recording apparatus according to claim 25, further comprising the ink sheet, wherein said ink sheet is provided with ink to be transferred onto the record medium for forming an image thereon, and a lift-off layer for lifting off the ink adhered to the record medium.

28. A recording apparatus according to claim 25, further comprising the ink sheet, wherein said ink sheet is a self-correction ribbon usable for both image recording and correction of a recorded image.

29. A recording apparatus according to claim 25, wherein said mounting section is further adapted to detachably mount an ink sheet used exclusively for correcting a recorded image.

30. A recording apparatus according to claim 25, further comprising heating means for heating the ink sheet, wherein the amount of heating by said heating means is varied between image recording and image correction.

31. A recording apparatus according to claim 25, further comprising heating means for heating the ink sheet, wherein said heating means is adapted to move along the record medium with different speeds during image recording and during image correction.

32. A recording apparatus according to claim 25, wherein said displacing means comprises a peeling lever for varying the timing of peeling of the ink sheet from the record medium after recording thereon.

33. A recording apparatus according to claim 25, further comprising means for removing slack in the ink sheet formed when said displacing means is disengaged from the ink sheet.

34. A recording apparatus according to claim 25, further comprising the ink sheet, wherein said ink sheet records said image on the record medium and peels the image recorded on the record medium from the record medium.

35. A recording apparatus according to claim 25, further comprising the ink sheet, wherein said ink sheet comprises ink to be transferred to the record medium to record the image on the record medium and a peeling layer for peeling the image recorded on the record medium from the record medium.

36. A recording apparatus according to claim 25, further comprising the ink sheet, wherein said ink sheet comprises a self-correction type ink ribbon which is adapted to record the image and erase the recorded image.

37. A recording apparatus according to claim 25, further comprising the ink sheet, wherein said mounting section is further adapted to detachably mount an ink sheet used exclusively for correcting a recorded image.

38. A recording apparatus according to claim 25, wherein said recording means applied heat to the ink sheet from the outer portion thereof to the inner portion thereof.

39. A recording apparatus according to claim 25, wherein said displacing means changes the conveyance path of the ink sheet in such a manner that the ink sheet contacts the record medium.

40. A recording apparatus according to claim 25, wherein said apparatus peels the ink sheet from the record medium after the ink sheet is transferred to the record medium, wherein said displacing means changes the time at which the ink sheet is peeled from the record medium after said recording means effects recording with the ink sheet.

41. A recording apparatus according to claim 40, wherein said displacing means comprises a lever for delaying the time when the ink sheet is peeled from the record medium after said recording means effects recording with the ink sheet.

42. A recording apparatus according to claim 25, wherein said displacing means comprises a lever projecting in the direction of the record medium.

43. A recording apparatus according to claim 41, wherein said lever of said displacing means is adapted to be displaced downwardly, wherein said recording means is displaced to said affecting position sequentially after said lever of said displacing means is displaced downwardly.

44. A recording apparatus according to claim 25, wherein said displacing means comprises a lever projecting in the direction of the record medium.

45. A recording apparatus according to claim 25, wherein said recording means is adapted to be displaced downwardly, sequentially after said movable element is displaced, for affecting the ink sheet.

46. A recording apparatus according to claim 25 further comprising:

an ink sheet cassette housing the ink sheet, mounted on said mounting section said cassette having:

an ink sheet supply portion for supporting the ink sheet;

an ink sheet supply portion for supporting the ink sheet;

an ink sheet take-up portion for winding the ink sheet supplied from said ink sheet supply portion;

a first driving force receiving portion;

transmitting means for transmitting a driving force to said first driving force receiving portion which receives the driving force which enables the ink sheet take-up portion to wind the ink sheet, wherein said transmitting means has a taking-up lever and a gear for transmitting the driving force to said first driving force receiving portion provided on said ink sheet cassette mounted on said mounting section.

47. A recording apparatus according to claim 25, further comprising:

an ink sheet cassette housing the ink sheet, mounted on said mounting portion, said cassette having:

an ink sheet supply portion for supporting the ink sheet;

an ink sheet take-up portion for winding the ink sheet supplied from said ink sheet supply portion;

a first driving force receiving portion;

transmitting means for transmitting a driving force to said first driving force receiving portion which receives the driving force which enables the ink sheet take-up portion to wind the ink sheet;

wherein said transmitting means has a connecting lever and a switching lever for transmitting the driving force to a second force receiving portion provided on said ink sheet cassette mounted on said mounting section.

* * * * *

UNITED STATES PATENT AND TRADEMARK OFFICE

CERTIFICATE OF CORRECTION

PATENT NO. 5,199,805

DATED April 6, 1993

INVENTOR(S) KENJI KAWAZOE, ET AL.

It is certified that error appears in the above-indentified patent and that said Letters Patent is hereby corrected as shown below:

COLUMN 3

Line 45, "Also" should read --Also,--.

COLUMN 5

Line 65, "B2" should read --E2--.

COLUMN 7

Line 26, "44" should read --44.--.

Line 51, "10" should read --10.--.

COLUMN 8

Line 39, "specifically" should read --specifically,--.

Line 54, "Also" should read --Also,--.

UNITED STATES PATENT AND TRADEMARK OFFICE

CERTIFICATE OF CORRECTION

PATENT NO. 5,199,805

DATED April 6, 1993

INVENTOR(S) KENJI KAWAZOE, ET AL.

It is certified that error appears in the above-indentified patent and that said Letters Patent is hereby corrected as shown below:

COLUMN 9

Line 6, "Consequently" should read --Consequently,--.
Line 10, "Also" should read --Also,--.
Line 25, "Also" should read --Also,--.
Line 30, "However" should read --However,--.
Line 33, "Consequently" should read --Consequently,--.
Line 54, "Consequently" should read --Consequently,--.
Line 60, "Consequently" should read --Consequently,--.

COLUMN 10

Line 3, "Consequently" should read --Consequently,--.
Line 6, "rated" should read --rated from--.
Line 30, "Consequently" should read --Consequently,--.
Line 36, "Thus" should read --Thus,--.
Line 39, "Consequently" should read --Consequently,--.

COLUMN 11

Line 6, "Consequently" should read --Consequently,--.

COLUMN 12

Line 24, "Subsequently" should read --Subsequently,--.
Line 67, "distance (," should read --distance 1,--.

UNITED STATES PATENT AND TRADEMARK OFFICE

CERTIFICATE OF CORRECTION

PATENT NO. 5,199,805

DATED April 6, 1993

INVENTOR(S) KENJI KAWAZOE, ET AL.

It is certified that error appears in the above-indentified patent and that said Letters Patent is hereby corrected as shown below:

COLUMN 14

Line 43, "Thus" should read --Thus,--.

COLUMN 15

Line 13, "Also" should read --Also,--.
Line 20, "Also" should read --Also,--.
Line 59, "through" (second occurrence) should read --though--.

COLUMN 16

Line 30, "Also" should read --Also,--.
Line 42, "Therefore" should read --Therefore,--.
Line 51, "Also" should read --Also,--.

COLUMN 18

Line 49, "Also" should read --Also,--.
Line 53, "Furthermore" should read --Furthermore,--.
Line 67, "For example" should read --For example,--.

UNITED STATES PATENT AND TRADEMARK OFFICE

CERTIFICATE OF CORRECTION

PATENT NO. 5,199,805 Page 4 of 5

DATED April 6, 1993

INVENTOR(S) KENJI KAWAZOE, ET AL.

It is certified that error appears in the above-indentified patent and that said Letters Patent is hereby corrected as shown below:

COLUMN 19

Line 1, "Furthermore" should read --Furthermore,--.
Line 22, "following" should read --following,--.
Line 39, "specifically" should read --specifically,--.

COLUMN 20

Line 34, "Also" should read --Also,--.

COLUMN 21

Line 24, "case" should read --case,--.
Line 51, "of" should read --for--.
Line 52, "U also" should be deleted.
Line 57, "Also" should read --Also,--.
Line 65, "Also" should read --Also,--.

COLUMN 23

Line 14, "Also" should read --Also,--.
Line 30, "Also" should read --Also,--.
Line 32, "more" should read --more,--.

UNITED STATES PATENT AND TRADEMARK OFFICE

CERTIFICATE OF CORRECTION

PATENT NO. : 5,199,805 Page 5 of 5

DATED : April 6, 1993

INVENTOR(S) : KENJI KAWAZOE, ET AL.

It is certified that error appears in the above-indentified patent and that said Letters Patent is hereby corrected as shown below:

COLUMN 24

Line 26, "claim 1" should read --claim 1,--.

COLUMN 25

Line 50, "claim 1" should read --claim 1,--.

COLUMN 26

Line 67, "claim 25" should read --claim 25,--.

COLUMN 28

Line 25, "claim 25" should read --claim 25,--.

Lines 31-32, should be deleted.

Signed and Sealed this

Seventh Day of December, 1993

Bruce Lehman

*Attest:*

BRUCE LEHMAN

*Attesting Officer*

*Commissioner of Patents and Trademarks*